US011630411B2

(12) United States Patent
Yamamoto et al.

(10) Patent No.: US 11,630,411 B2
(45) Date of Patent: Apr. 18, 2023

(54) ELECTROPHOTOGRAPHIC CLEANING BLADE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Arihiro Yamamoto, Shizuoka (JP); Syoji Inoue, Shizuoka (JP); Masahiro Watanabe, Shizuoka (JP); Toshirou Uchida, Shizuoka (JP); Youhei Ikeda, Shizuoka (JP); Masanori Yokoyama, Shizuoka (JP); Hisao Kato, Kanagawa (JP); Saki Sudo, Kanagawa (JP); Tomoya Kawakami, Shizuoka (JP); Masaaki Kimura, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/826,671

(22) Filed: May 27, 2022

(65) Prior Publication Data

US 2022/0291622 A1 Sep. 15, 2022

Related U.S. Application Data

(63) Continuation of application No. PCT/JP2020/044851, filed on Dec. 2, 2020.

(30) Foreign Application Priority Data

Dec. 4, 2019 (JP) ..... JP2019-219957
Jul. 31, 2020 (JP) ..... JP2020-130824

(51) Int. Cl.
*G03G 21/00* (2006.01)

(52) U.S. Cl.
CPC ..... *G03G 21/0017* (2013.01)

(58) Field of Classification Search
CPC ..... G03G 21/0011; G03G 21/0017
(Continued)

(56) References Cited

U.S. PATENT DOCUMENTS 8,787,813 B2 7/2014 Tano et al.
9,354,559 B2 5/2016 Nakamura et al.
(Continued)

FOREIGN PATENT DOCUMENTS

JP 2010-134310 A 6/2010
JP 2014-066787 A 4/2014
(Continued)

OTHER PUBLICATIONS

International Search Report in International Application No. PCT/JP2020/044851 (dated Jan. 2021).

*Primary Examiner* — William J Royer
(74) *Attorney, Agent, or Firm* — Venable LLP

(57) ABSTRACT

The present invention is aimed at providing an electrophotographic cleaning blade that has excellent chipping resistance and can exhibit excellent cleaning performance. This cleaning blade is provided with an elastic member that includes a polyurethane and a support member that supports the elastic member, and cleans the surface of a member to be cleaned that is moving, by bringing a part of the elastic member into contact with the surface of the member to be cleaned. The average value of the elastic modulus of the elastic member obtained when measured using SPM is at least 15 MPa and not more than 470 MPa, and the coefficient of variation thereof is not more than 6.0%.

7 Claims, 8 Drawing Sheets

(58) Field of Classification Search
USPC ..... 399/350
See application file for complete search history.

(56) References Cited

U.S. PATENT DOCUMENTS

| | | | | |
|---|---|---|---|---|
| 9,632,474 | B2 | 4/2017 | Yamamoto et al. | |
| 9,996,047 | B2 | 6/2018 | Kawakami et al. | |
| 10,042,315 | B2 * | 8/2018 | Shimizu et al. ... | G03G 21/0011 |
| 10,088,795 | B2 | 10/2018 | Ikeda et al. | |

FOREIGN PATENT DOCUMENTS

| | | | |
|---|---|---|---|
| JP | 2016-009078 | A | 1/2016 |
| JP | 2016-014740 | A | 1/2016 |
| JP | 2017-016125 | A | 1/2017 |
| JP | 2019-023672 | A | 2/2019 |
| WO | 2021/112123 | A1 | 6/2021 |

* cited by examiner

ELECTROPHOTOGRAPHIC CLEANING BLADE, PROCESS CARTRIDGE, AND ELECTROPHOTOGRAPHIC IMAGE FORMING APPARATUS

CROSS-REFERENCE TO RELATED APPLICATION

This is a continuation of International Application No. PCT/JP2020/044851, filed on Dec. 2, 2020, which claims the benefit of Japanese Patent Application No. 2019-219957 filed on Dec. 4, 2019 and Japanese Patent Application No. 2020-130824 filed on Jul. 31, 2020, all of which are hereby incorporated by reference herein after in their entirety.

BACKGROUND OF THE INVENTION

Field of the Invention

The present disclosure relates to a cleaning blade for use in an electrophotographic apparatus, a process cartridge, and an electrophotographic image forming apparatus.

Description of the Related Art

In an electrophotographic apparatus, a cleaning member is provided for removing a toner remaining on the surface of an image bearing member, such as a photosensitive member, or an intermediate transfer member after transferring a toner image from the image bearing member or intermediate transfer member onto a transfer member (hereinafter, the image bearing member and the intermediate transfer member are also referred to as members to be cleaned). One of these cleaning members is a cleaning blade.

PTL 1 discloses a cleaning blade made of a polyurethane member which includes a polyurethane material including hard segments and soft segments and in which the proportion of the area occupied by hard segment aggregates with a diameter of at least 0.3 μm and not more than 0.7 μm in a cross section is at least 2% and not more than 10%. It is disclosed that with such a cleaning blade, both chipping resistance and wear resistance can be achieved.

According to the studies conducted by the present inventors, the cleaning blade of PTL 1 still has room for improvement terms of chipping resistance. Specifically, for example, when the cleaning blade is used for a long period of time in a low-temperature and low-humidity environment such as a temperature of 15° C. and a relative humidity of 10%, chipping may occur.

CITATION LIST

Patent Literature

PTL 1 Japanese Patent Application Publication No. 2016-14740

SUMMARY OF THE INVENTION

At least one aspect of the present disclosure is directed to providing an electrophotographic cleaning blade that has excellent chipping resistance and can stably exhibit excellent cleaning performance. Further, another aspect of the present disclosure is directed to providing a process cartridge that contributes to stable formation of high-quality electrophotographic images. Furthermore, yet another aspect of the present disclosure is directed to providing an electrophotographic image forming apparatus capable of stably forming high-quality electrophotographic images.

According to one aspect of the present disclosure, there is provided an electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 10 μm from the tip-side edge is drawn on the tip surface in parallel with the tip-side edge, where a length of the line segment is denoted by L and points at ⅛L, ½L, and ⅞L from one end side on the line segment are denoted by P0, P1, and P2, respectively, an average value of an elastic modulus of the elastic member measured using SPM at each of 70 points with a pitch of 1 μm on the line segment centered on each of the P0, the P1 and the P2 on the line segment is at least 15 MPa and not more than 470 MPa;

a coefficient of variation of the elastic modulus is not more than 6.0%; and the absolute value of a difference between a Martens hardness HM1 of the elastic member measured at the position of P1 and a Martens hardness HM2 measured at a position on a bisector at a distance of 500 μm from the tip-side edge, when assumed that the bisector of an angle formed by the main surface and the tip surface is drawn on a cross section of the elastic member including the P1 and orthogonal to the tip surface and the tip-side edge, is not more than 0.10 $N/mm^2$.

According to another aspect of the present disclosure, there is provided an electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 10 μm from the tip-side edge is drawn on the tip surface in parallel with the tip-side edge, and when a length of the line segment is denoted by L and points at ⅛L, ½L, and ⅞L from one end side on the line segment are denoted by P0, P1, and P2, respectively, in each of three square observation regions on the tip surface having each of the P0, the P1, and the P2 as a center of gravity and a side length of 1 μm and one side parallel to the line segment, and also have a proportion [(S2/S1)×100] of a number (S2) of hard segments having a circle-equivalent diameter of not more than 40 nm in a total number (S1) of hard segments is at least 92% or more, and the S1 is at least 300 and not more than 1500.

According to another aspect of the present disclosure, there is provided an electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 0.5 mm from the tip-side edge is drawn on the tip surface in parallel with the tip-side edge, where a length of the line segment is denoted by L' and points at ⅛L', ½L', and ⅞L' from one end side on the line segment are denoted by P0', P1', and P2', respectively, and when a sample sampled at each of the P0', the P1', and the P2' is heated to 1000° C. at a temperature rise rate of 10° C./s by using a mass analyzer of a direct sample introduction type in which the sample is heated and vaporized in an ionization chamber and the sample molecules are ionized, where a detection amount of all ions is denoted by M1, an integrated intensity of a peak of an extracted ion thermogram corresponding to an m/z value in a range of 380.5 to 381.5 derived from a polymeric MDI is denoted by M2, an integrated intensity of a peak of an extracted ion thermogram corresponding to an m/z value in a range of 249.5 to 250.5 derived from 4,4'-MDI is denoted by M3, and an integrated intensity of a peak of an extracted ion thermogram corresponding to an m/z value in a range of 749.5 to 750.5 derived from an isocyanurate form of 4,4'-MDI is denoted by M4, M2/M1 is 0.001 to 0.015, M3/M1 is 0.04 to 0.10, and M4/M1 is not more than 0.001, and a concentration of a trifunctional alcohol in the polyurethane is 0.22 to 0.39 mmol/g.

According to another aspect of the present disclosure, there is provided an electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 0.5 mm from the tip-side edge is drawn on the tip surface in parallel with the tip-side edge, where a length of the line segment is denoted by L' and points at ⅛L', ½L', and ⅞L' from one end side on the line segment are denoted by P0', P1', and P2', respectively, in a DSC chart obtained by differential scanning calorimetry of samples sampled in each of the P0', the P1', and the P2', a peak top temperature of the only endothermic peak is at least 200° C., a melting start temperature of the endothermic peak is at least 175° C., and a difference between the melting start temperature and the peak top temperature is at least 15° C.

Further, according to yet another aspect of the present disclosure, there is provided a process cartridge having the electrophotographic cleaning blade. Furthermore, according to still another aspect of the present disclosure, there is provided an electrophotographic image forming apparatus having the electrophotographic cleaning blade.

Further features of the present invention will become apparent from the following description of exemplary embodiments with reference to the attached drawings.

DESCRIPTION OF THE EMBODIMENTS

In the present disclosure, the description of "at least XX and not more than YY" or "XX to YY" indicating a numerical range means a numerical range including a lower limit and an upper limit which are end points, unless otherwise specified.

When the numerical range is described step by step, the upper and lower limits of each numerical range can be arbitrarily combined.

Examples of a member to be cleaned to which an electrophotographic cleaning blade according to one aspect of the present disclosure (hereinafter, also simply referred to as "cleaning blade") can be applied include an image bearing member such as a photosensitive member, an endless belt such as an intermediate transfer belt, and the like. Hereinafter, an embodiment of the cleaning blade according to one aspect of the present disclosure will be described in detail by taking an image bearing member as an example of the member to be cleaned, but the present invention is not limited thereto.

<Configuration of Cleaning Blade>

Figure 1:
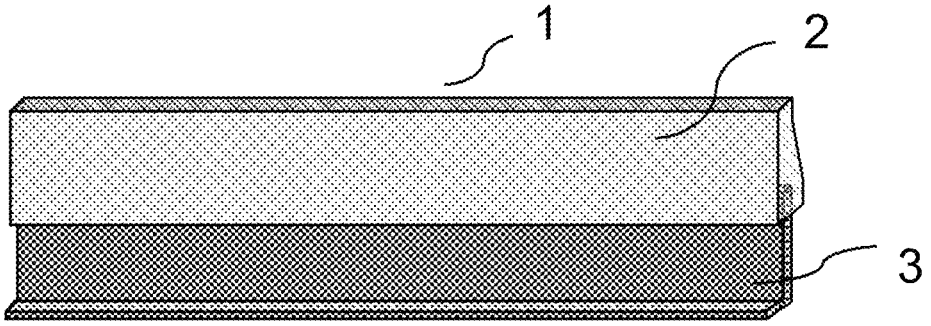
FIG. 1 is a schematic perspective view of an electrophotographic cleaning blade according to one aspect of the present disclosure.

FIG. 1 is a schematic perspective view of a cleaning blade 1 according to one aspect of the present disclosure. The cleaning blade 1 includes an elastic member 2 and a support member 3 that supports the elastic member 2.

The symbols in FIGS. 1, 2, 6 and 9 are as follows. 1: Cleaning blade, 2: Elastic member, 3: Support member, 4: Main surface facing the member to be cleaned, 5: Tip surface forming the tip-side edge together with the main surface, 6: Member to be cleaned, R: Rotation direction of the member to be cleaned.

Figure 2:
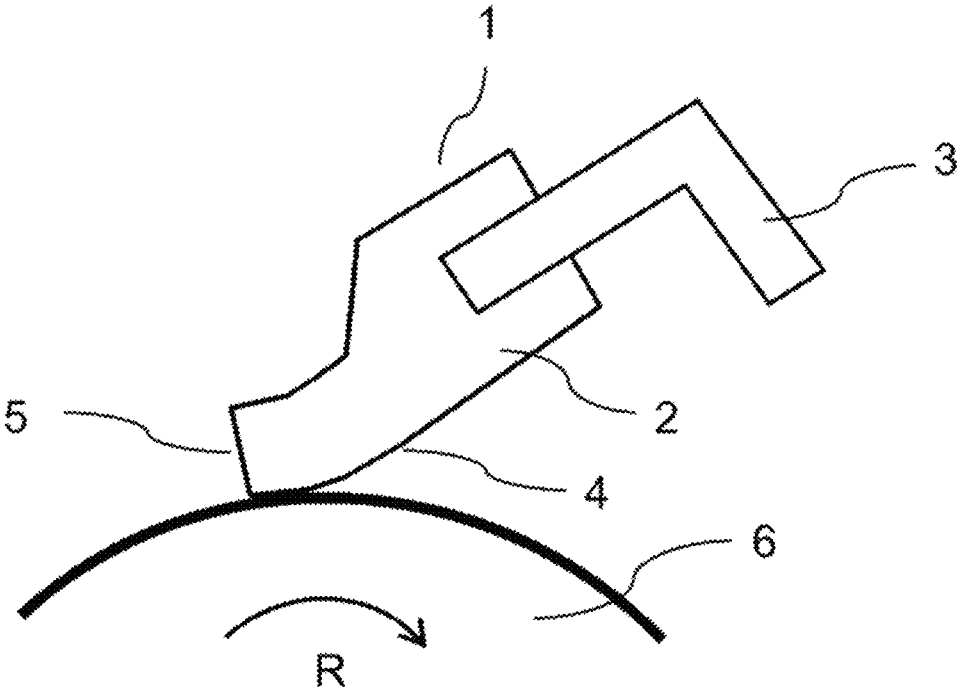
FIG. 2 shows a state in which a edge of the cleaning blade is in contact with a member to be cleaned when a process cartridge is stationary.

FIG. 2 is an example schematically showing the state of a cross section in which the cleaning blade according to one aspect of the present disclosure is in contact with the member to be cleaned. The side of the cleaning blade that comes into contact with the surface of the member to be cleaned is defined as the tip side of the cleaning blade. The elastic member 2 has a plate shape having a main surface 4 facing a member 6 to be cleaned and a tip surface 5 forming a tip-side edge together with the main surface 4. R indicates the rotation direction of the member to be cleaned. A part of the elastic member is brought into contact with the surface of the moving member to be cleaned to clean the surface of the member to be cleaned.

The present inventors have found that, for example, a cleaning blade of the below-described form can exhibit excellent chipping resistance and excellent cleaning performance.

Figure 3:
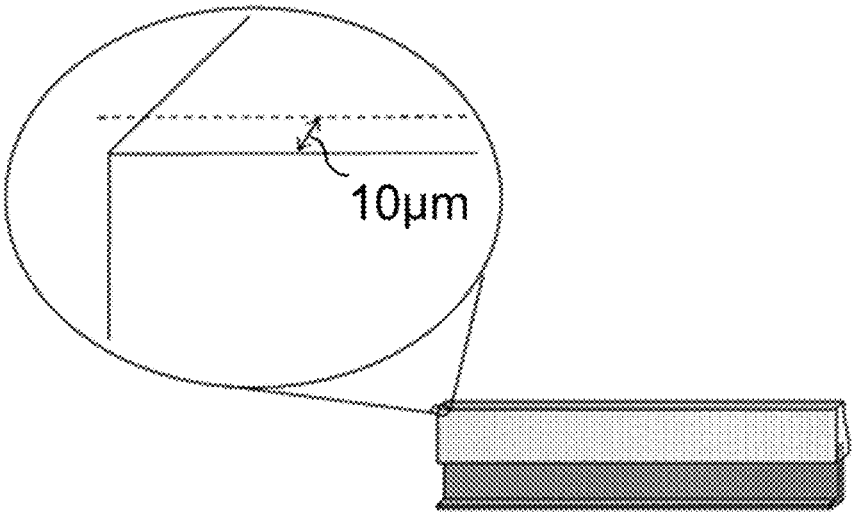
FIG. 3 shows a line segment that is parallel to a tip-side edge and has a distance of 10 μm from the tip-side edge on a tip surface, the line segment being used for measuring an elastic modulus by SPM.
Figure 4:
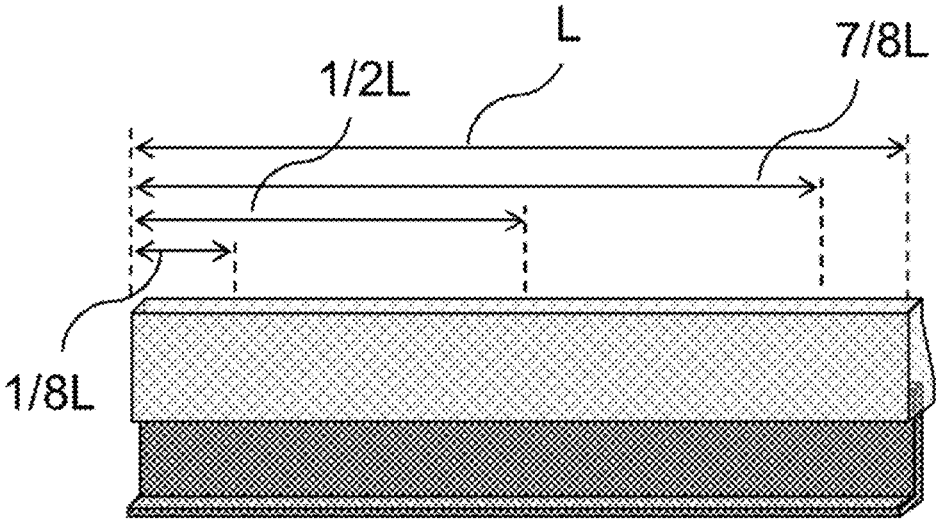
FIG. 4 shows a cutout position of a sample for SPM measurement.
Figure 5:
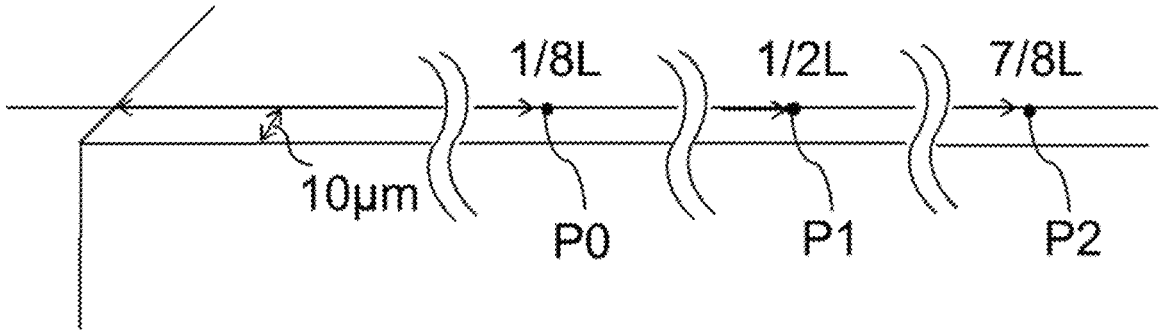
FIG. 5 shows positions for SPM measurement and for measuring a Martens hardness HM1.

Assuming that a line segment having a distance of 10 μm from the tip-side edge is drawn on the tip surface of the elastic member including a polyurethane in parallel with the tip-side edge, the length of the line segment is denoted by L, and points at ⅛L, ½L, and ⅞L from one end side on the line segment are denoted by P0, P1, and P2, respectively (see FIGS. 3, 4, and 5). An average value of an elastic modulus of the elastic member measured using SPM at each of 70 points with a pitch of 1 μm on the line segment that are centered on each of the P0, P1 and P2 on the line segment is at least 15 MPa and not more than 470 MPa.

Where the average value of the elastic modulus is at least 15 MPa, the contact pressure required for cleaning can be obtained, and where the average value of the elastic modulus is not more than 470 MPa, the elastic member does not become too hard and has good followability to the image bearing member, so that the occurrence of cleaning defects can be suppressed.

Where the number of durability prints increases, the image bearing member such as a photosensitive member is rubbed against a contact member in a state where a toner including fine particles is present thereon, so that the surface is scraped and streaky irregularities appear in the circumferential direction. Therefore, where the followability is poor, cleaning defects are likely to occur, but where the average elastic modulus is not more than 470 MPa, the elastic member will follow the image bearing member even in the state where the surface of the image bearing member such as a photosensitive member has streaky irregularities. Therefore, it is possible to suppress the occurrence of cleaning defects.

The average value of the elastic modulus is preferably at least 15 MPa and not more than 60 MPa.

Further, a coefficient of variation of the elastic modulus of the elastic member is not more than 6.0%. Furthermore, the coefficient of variation is preferably not more than 3.4%.

The coefficient of variation is calculated by a following formula (1).

$$\text{Coefficient of variation (\%)} = \text{standard deviation}/\text{average value of elastic modulus} \times 100 \qquad \text{Formula (1)}$$

A polyurethane (specifically, a polyurethane elastomer) is composed of hard segments and soft segments, and it is known that a polyurethane (polyurethane elastomer) having changed mechanical properties can be obtained by changing the amount of hard segments having a reinforcing effect. However, when the aggregation of hard segments is promoted, the hard segments become large, and as a result, the contact area with the soft segments increases. Therefore, when the polyurethane is used in a stressed state such as that of a cleaning blade edge, the hard segments are likely to fall out of the soft segment portions, and such fall-out initiates the edge chipping. In order to cope with size reduction and spheroidization of toner particles, which have been promoted due to the demand for high image quality, it is preferable to suppress the edge chipping to less than 3 μm, and more preferably to less than 1 μm.

As the aggregation of hard segments progresses, the separation of hard segments and soft segments progresses at the same time. When the elastic modulus of the cleaning blade in such state is measured at 70 points at a pitch of 1 μm by using SPM described hereinbelow, the coefficient of variation of the elastic modulus becomes large even if the average value of the elastic modulus falls within the above range. That is, the presence of hard segments with advanced aggregation that causes edge chipping can be indicated by the coefficient of variation being larger than 6.0%.

Meanwhile, in the cleaning blade of the present disclosure, the aggregation of hard segments is suppressed, the hard segments are finely dispersed, and the dispersion is uniform and homogeneous. Therefore, when the elastic modulus is measured using SPM described hereinbelow, the variation between the measured values is small and the coefficient of variation of the elastic modulus is small.

Therefore, even when the average value of the elastic modulus is at least 15 MPa and not more than 470 MPa at the specific locations on the line segment, the coefficient of variation of the elastic modulus can be made not more than 6.0%. Since the hard segments of the entire elastic member are finely dispersed, and the dispersion is uniform and homogeneous, as described above, edge chipping due to the fall-out of the hard segments is unlikely to occur. Further, in a low-temperature environment, the viscosity becomes high due to temperature characteristics of the urethane elastomer, and the contact pressure tends to be insufficient. Therefore, even if edge chipping is present at a small degree, cleaning is likely to be defective. Since with the cleaning blade of the present disclosure, edge chipping can be suppressed, it is possible to suppress the occurrence of cleaning defects even in a low-temperature environment.

When the amount of hard segments is reduced, the coefficient of variation may be not more than 6.0% due to the increase in the soft segment portions, but the average value of the elastic modulus becomes less than 15 MPa, sufficient contact pressure is not applied, and streak-shaped image defects occur due to the toner slipping through.

By introducing a structure with low regularity or low crystallinity into the hard segments, the aggregation of hard segments can be suppressed. Further, where the crystallinity of soft segments also becomes high, the soft segments tend to gather, and as a result, the hard segments are unlikely to be dispersed. Therefore, by introducing a structure having low crystallinity into the soft segments, the aggregation of hard segment can be suppressed.

Further, assuming that a line segment having a distance of 10 μm from the edge is drawn on the tip surface of the elastic member in parallel with the edge, the length of the line segment is denoted by L, and the Martens hardness at the point P1 at ½L from one end side of the line segment is used is denoted by HM1.

Figure 6:
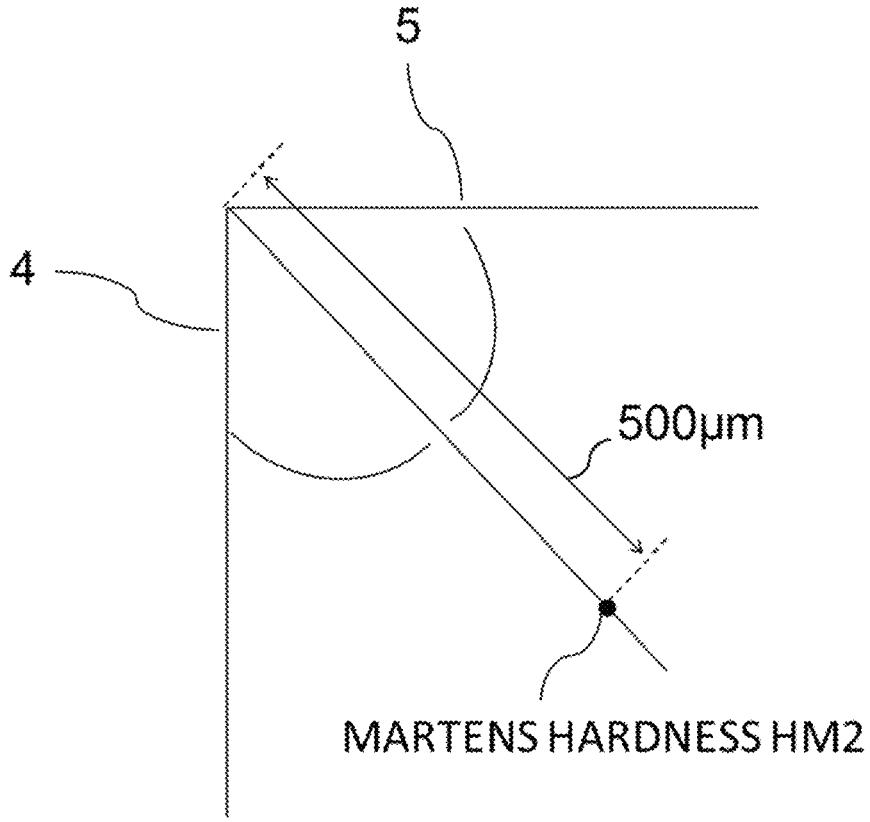
FIG. 6 shows a position where a Martens hardness HM2 is measured.

Further, assuming that a bisector of the angle formed by the main surface and the tip surface is drawn on a cross section including the P1 and orthogonal to the tip surface and the tip-side edge, the Martens hardness of the elastic member measured at a position on the drawn bisector at a distance of 500 μm from the tip-side edge is denoted by HM2 (see FIG. 6). In the elastic member of the present disclosure, the absolute value of the difference between the Martens hardness HM1 and the Martens hardness HM2 is not more than 0.10 $N/mm^2$. Further, the absolute value of the difference between the Martens hardness HM1 and the Martens hardness HM2 is preferably not more than 0.05 $N/mm^2$.

In order to increase the contact pressure, a method such as increasing the hardness of the blade surface by surface treatment is performed, but in this case, the hardness of the treated layer and inside the blade changes, thereby facilitating chipping from the boundary portion of the hardness. When the absolute value of the difference between HM1 and HM2 is not more than 0.10 $N/mm^2$, the hardness difference between the inside and the surface is small, and edge chipping that tends to occur in the hardness boundary region when the contact pressure is increased in a low-temperature environment can be suppressed.

Figure 7:
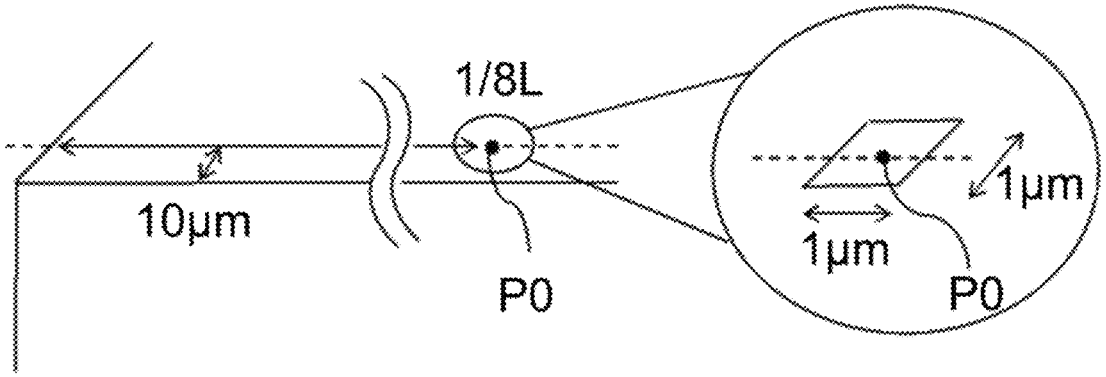
FIG. 7 shows a position for measuring a size and number of hard segments.
Figure 8:
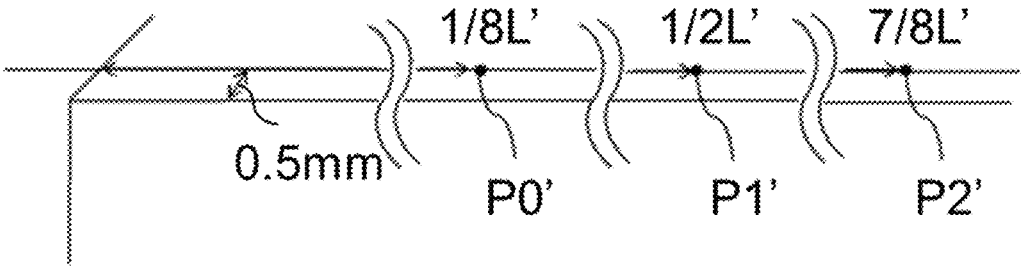
FIG. 8 shows a position where measurement is performed by a direct sample introduction method (DI method).

Assuming that a line segment having a distance of 10 μm from the tip-side edge is drawn on the tip surface of the elastic member including a polyurethane in parallel with the tip-side edge, the length of the line segment is denoted by L, and points at ⅛L, ½L, and ⅞L from one end side on the line segment are denoted by P0, P1, and P2, respectively. Squares on the tip surface that have a side length of 1 μm and one side parallel to the line segment and also have each of the points P0, P1 or P2 as the center of gravity are taken as observation regions. The proportion ((S2/S1)×100) of the number (S2) of hard segments having a circle-equivalent diameter of not more than 40 nm in the total number (51) of hard segments in each observation region is at least 92% or more and the S1 is at least 300 and not more than 1500 (see FIG. 7).

Where the total number S1 of hard segments per 1 $\mu m^2$ is 300 or more, and the proportion [(S2/S1)×100] of the number (S2) of hard segments having a circle-equivalent diameter of not more than 40 nm is at least 92%, the aggregation of hard segments is suppressed and a state in which the hard segments are finely dispersed is achieved. Therefore, the hard segment portion is less likely to fall out of the soft segment portion, and the edge chipping of the cleaning blade can be suppressed. Where the total number S1 of hard segments is not more than 1500, the cleaning blade does not become too hard and has good followability to the image bearing member, so that the occurrence of cleaning defects can be suppressed.

The [(S2/S1)×100] is preferably at least 95% and not more than 100%.

The S1 is preferably at least 630 and not more than 1380.

Assuming that a line segment having a distance of 0.5 mm from the tip-side edge is drawn on the tip surface of the elastic member including a polyurethane in parallel with the tip-side edge, the length of the line segment is denoted by L' and points at ⅛L', ½L', and ⅞L' from one end side on the line segment are denoted by P0', P1', and P2', respectively. Where a detection amount of all ions is denoted by M1, an integrated intensity of a peak of an extracted ion thermogram corresponding to an m/z value in the range of 380.5 to 381.5 derived from a polymeric MDI is denoted by M2, an integrated intensity of a peak of an extracted ion thermogram corresponding to an m/z value in the range of 249.5 to 250.5 derived from 4,4'-MDI is denoted by M3, and an integrated intensity of a peak of an extracted ion thermogram corresponding to an m/z value in the range of 749.5 to 750.5 derived from an isocyanurate form of 4,4'-MDI is denoted by M4, those M1, M2, M3, and M4 being obtained when a sample sampled at each of P0', P1', and P2' is heated to 1000° C. at a temperature rise rate of 10° C./s by using a mass analyzer of a direct sample introduction type in which the sample is heated and vaporized in an ionization chamber and the sample molecules are ionized, M2/M1 is 0.001 to 0.015, M3/M1 is 0.04 to 0.10, and M4/M1 is not more than 0.001.

The polyurethane preferably includes a reaction product of a composition including an isocyanate compound inclusive of diisocyanates and polyfunctional isocyanates that are at least trifunctional, and an alcohol inclusive of polyfunctional alcohols that are at least trifunctional. For example, the polyurethane preferably includes a crosslinking reaction product (allophanate reaction product) of a polymer of a composition including polymeric MDI represented by a following chemical formula (1) and 4,4'-MDI represented by a following chemical formula (2) and a trifunctional alcohol.

An alcohol having three hydroxyl groups in one molecule is called a trifunctional alcohol.

Polymeric MDI is represented by the following chemical formulas (1) and (1)'.

It is preferable that n in the chemical formula (1)' be at least 1 and not more than 4.

The chemical formula (1) is obtained when n is 1 in the chemical formula (1)'.

Chemical formula (1)

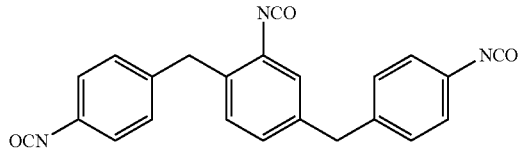

-continued

Chemical formula (1)'

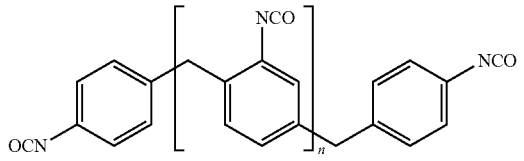

4,4'-MDI is represented by the following chemical formula (2).

Chemical formula (2)

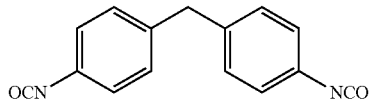

The isocyanurate form of 4,4'-MDI is represented by the following chemical formula (3).

Chemical formula (3)

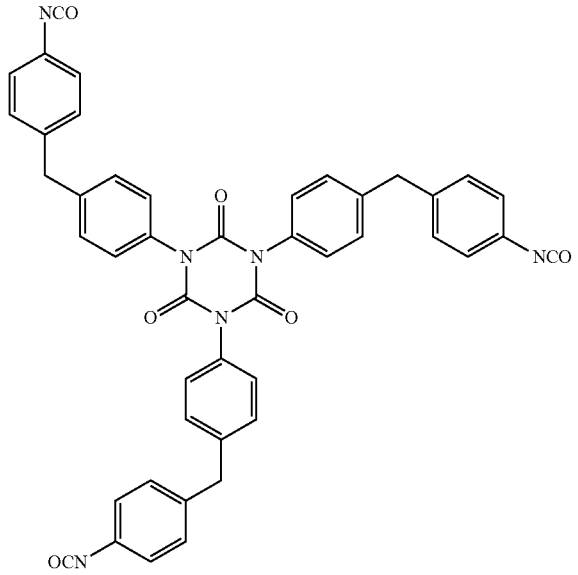

Where M2/M1 is at least 0.001, a structure having low crystallinity, for example, derived from polymeric MDI is introduced into the polyisocyanate forming hard segments, the aggregation of hard segments is suppressed and the hard segments can be finely dispersed. Therefore, the hard segments can be prevented from falling out of the soft segment portion, and it is possible to suppress the edge chipping initiated by the fall-out of hard segments.

Where M2/M1 is not more than 0.015, the amount of crosslinking derived from the polymeric MDI is in an appropriate range, so that hardness does not become excessive, and therefore, the followability to the image bearing member is good and the occurrence of cleaning defects can be suppressed.

The M2/M1 is preferably 0.003 to 0.014.

Since the difunctional polyisocyanate has a structure that facilitating chain extension as compared with at least trifunctional polyisocyanates, the molecular weight is easily increased and wear resistance can be improved. Among the bifunctional polyisocyanates, 4,4'-MDI is preferable because the reactivity of the two isocyanate groups is the same and the molecular weight is easily increased.

A compound having one isocyanate group in a molecule is expressed as a monofunctional isocyanate, and a compound having n isocyanate groups is expressed as an n-functional isocyanate.

When M3/M1 is at least 0.04 where M3 is the integrated intensity of the peak of the extracted ion thermogram corresponding to an m/z value in the range of 249.5 to 250.5 derived from 4,4'-MDI, the molecular weight is easily increased in the curing reaction, and the wear resistance can be improved.

Since 4,4'-MDI has a highly symmetric structure, where the amount of 4,4'-MDI is large, the hard segments tend to aggregate. Therefore, by setting M3/M1 to not more than 0.10, it is possible to suppress the aggregation of hard segments and suppress the chipping of edge initiated by the fall-out of hard segments.

The M3/M1 is preferably 0.04 to 0.08.

By introducing the isocyanurate form structure of 4,4'-MDI, the effect of suppressing the aggregation of hard segments of only 4,4'-MDI can be obtained, and edge chipping initiated by the fall-out of hard segments can be suppressed. However, the excessive isocyanurate form structure of 4,4'-MDI increases stress relaxation, and as a result, the cleaning property deteriorates due to the decrease in contact pressure. Therefore, M4/M1 is set to not more than 0.001, so that the deterioration of cleaning property can be suppressed.

Assuming that a line segment having a distance of 0.5 mm from the tip-side edge is drawn on the tip surface in parallel with the tip-side edge, where the length of the line segment is denoted by L' and points at ⅛L', ½L', and ⅞L' from one end side on the line segment are denoted by P0', P1', and P2', respectively, in a DSC chart obtained by differential scanning calorimetry of samples sampled in each of the P0', the P1', and the P2',

- a peak top temperature of the only endothermic peak is at least 200° C.,
- a melting start temperature of the endothermic peak is at least 175° C., and
- the difference between the melting start temperature and the peak top temperature is at least 15° C.

The polyurethane preferably includes a crosslinking reaction product (alofanate) of a polymer of a composition including polymeric MDI represented by the chemical formula (1) and 4,4'-MDI represented by the chemical formula (2) and a trifunctional alcohol.

As described above, where the aggregation of hard segments is promoted, it leads to edge chipping, but when an endothermic peak of less than 200° C. is present in the DSC chart obtained by differential scanning calorimetry, a hard segment aggregate melting phenomenon is demonstrated. In other words, in the state where the aggregation of hard segments is suppressed, the melting phenomenon does not become apparent, so that the endothermic peak of less than 200° C. does not occur.

Further, in order to suppress edge chipping due to the fall-out of hard segments, it is necessary that the hard segment be in a finely dispersed state. The molecular motion of hard segment in a finely dispersed state is present as a broad endothermic peak derived from hydrogen bonds in the polyurethane structure. With the broad endothermic peak, the melting start temperature of the endothermic peak is at least 175° C., and the peak top temperature of the only endothermic peak is at least 200° C. Further, in the broad peak, the difference between the melting start temperature and the peak top temperature is at least 15° C.

Regarding the differential scanning calorimetry of the polyurethane, first, by performing an annealing step at 80° C. for 4 h, it is possible to remove the peak derived from the aggregation of soft segments, and the endothermic peak derived from the hard segment can be accurately measured.

The peak top temperature of the only endothermic peak is preferably at least 210° C. Further, it is preferably not more than 213° C.

The melting start temperature of the endothermic peak is preferably at least 182° C. Further, it is preferably not more than 190° C.

The difference between the melting start temperature and the peak top temperature is preferably at least 22° C. Further, it is preferably not more than 28° C.

[Support Member]

The material constituting the support member of the cleaning blade of the present disclosure is not particularly limited, and examples thereof include the following materials. Metallic materials such as steel sheets, stainless steel sheets, galvanized steel sheets, chromium-free steel sheets, and resin materials such as 6-nylon and 6,6-nylon. Further, the structure of the support member is not particularly limited. As shown in FIG. 2 etc., one end of the elastic member of the cleaning blade is supported by the support member.

[Elastic Member]

A polyurethane elastomer constituting the elastic member is mainly obtained from raw materials such as a polyol, a chain extender, a polyisocyanate, a catalyst, other additives, and the like. Hereinafter, these raw materials will be described in detail.

Examples of the polyol include the following. Polyester polyols such as polyethylene adipate polyol, polybutylene adipate polyol, polyhexylene adipate polyol, (polyethylene/polypropylene) adipate polyol, (polyethylene/polybutylene) adipate polyol, (polyethylene/polyneopentylene) adipate polyol, and the like; polycaprolactone-based polyols obtained by open-ring polymerization of caprolactone; polyether polyols such as polyethylene glycol, polypropylene glycol, polytetramethylene glycol, and the like; and polycarbonate diols, and these can be used alone or in combination of two or more. Among the above-mentioned polyols, a polyester polyol using an adipate is preferable because a polyurethane elastomer having excellent mechanical properties can be obtained.

In particular, those using glycols having four or more carbon atoms, such as polybutylene adipate polyol and polyhexylene adipate polyol, are more preferable. Further, it is preferable to use polyols that differ in the number of carbon atoms of glycol, such as polybutylene adipate polyol and polyhexylene adipate polyol, in combination. The presence of different types of polyols suppresses the crystallization of soft segments, so that the aggregation of hard segments can be suppressed.

As the chain extender, glycols and polyhydric alcohols capable of extending the polyurethane elastomer chain can also be used. Examples of glycols include the following. Ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. Examples of trihydric or higher polyhydric alcohols include trimethylolpropane, glycerin, pentaerythritol, and sorbitol. These can be used alone or in combination of two or more.

Introducing crosslinking can be mentioned as one of the methods for improving the elastic modulus of polyurethane elastomers. As a method for introducing crosslinking, it is preferable to use a polyhydric alcohol as the chain extender.

Further, where the number of branches is too large, it is difficult to react all the hydroxyl groups and it is difficult to obtain the intended degree of crosslinking. Therefore, it is more preferable to use a trifunctional alcohol among the polyhydric alcohols. Among the trifunctional alcohols, trimethylolpropane (TMP), which has a methylene skeleton next to the hydroxyl group, thereby creating a molecularly flexible crosslinked structure and also exerting an effect of suppressing the crystallinity of the hard segment, is more preferable.

The concentration of the trifunctional alcohol calculated by the following formula (2) is preferably 0.22 to 0.39 mmol/g. The concentration of at least 0.22 mmol/g is very effective in suppressing the aggregation of hard segments, and the edge chipping of the cleaning blade can be further suppressed. Where the concentration is not more than 0.39 mmol/g, the elastic modulus due to crosslinking introduction does not become too high, and therefore, the followability to the image bearing member is very good, so that the occurrence of cleaning defects can be further suppressed.

Concentration of trifunctional alcohol (mmol/g)=

[Trifunctional alcohol amount (g)/Trifunctional alcohol molecular weight×1000]/[Polyurethane mass (g)] Formula (2)

Examples of the polyisocyanate include the following. 4,4'-Diphenylmethane diisocyanate (4,4'-MDI), polymeric MDI, 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diocyanide (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), and carbodiimide-modified MDI. Among these, 4,4'-MDI is preferable because the two isocyanate groups have the same reactivity and high mechanical properties can be obtained. Further, since the polyisocyanate, which forms hard segments, itself has a branched structure, it is more preferable to use in combination at least trifunctional isocyanate having a very high effect of suppressing the aggregation of hard segments, for example, polymeric MDI.

As the catalyst, catalysts commonly used for curing a polyurethane elastomer can be used, for example, tertiary amine catalysts, and specific examples thereof include the following. Amino alcohols such as dimethylethanolamine, N,N,N'-trimethylaminopropylethanolamine, and N,N'-dimethylhexanolamine; trialkylamines such as triethylamine; tetraalkyldiamines such as N,N,N'N'-tetramethyl-1,3-butanediamine; triethylenediamine, piperazine-based compounds, and triazine-based compounds. Further, organic acid salts of metals such as potassium acetate, potassium alkali octylate, and the like can also be used. Further, a metal catalyst usually used for urethanization, for example, dibutyltin dilaurate can also be used. These can be used alone or in combination of two or more.

Additives such as pigments, plasticizers, waterproofing agents, antioxidants, ultraviolet absorbers, light stabilizers, and the like can be added, if necessary, to the raw materials constituting the elastic member.

<Method for Manufacturing Cleaning Blade>

A method for manufacturing the cleaning blade according to the present disclosure is not particularly limited, and a suitable method may be selected from known methods. For example, a cleaning blade in which a plate-shaped blade member and a support member are integrated can be obtained by arranging the support member in a mold for a cleaning blade, then injecting a polyurethane raw material composition into a cavity and heating and curing. Further, a method can also be used in which a polyurethane elastomer sheet is separately molded from the polyurethane raw material composition, a strip-shaped elastic member is cut therefrom, the adhesive portion of the elastic member is superposed on the support member coated or adhered with an adhesive, and bonding is performed by heating and pressurizing.

By performing surface treatment, it is possible to increase the elastic modulus measured using SPM on the tip surface of the cleaning blade. A light source used in the surface treatment step generates ultraviolet rays. In particular, it is preferable that the wavelength of the maximum emission peak be in the vicinity of 254 nm, for example, in the range of 254±1 nm. This is because the ultraviolet rays in the above wavelength range or having the above wavelength can efficiently generate active oxygen that modifies the polyurethane surface. When there is a plurality of ultraviolet emission peaks, it is preferable that one of them be present in the vicinity of 254 nm.

The intensity of light emitted from the light source is not particularly limited, and a value measured using a spectroscopic illuminance meter (USR-40V/D, manufactured by Ushio, Inc.), an ultraviolet integrated photometer (UIT-150-A, UVD-S254, VUV S172, and VUV-S365, manufactured by Ushio, Inc.) or the like can be adopted. Further, the integrated luminous energy of ultraviolet rays radiated to the polyurethane in the surface treatment step may be selected, as appropriate, according to the effect of the surface treatment to be obtained. The irradiation can be performed by varying the irradiation time by the light from the light source, the output of the light source, the distance from the light source, and the like, and these may be determined so as to obtain a desired integrated luminous energy such as 10000 $mJ/cm^2$.

The integrated luminous energy of ultraviolet rays emitted to the conductive member can be calculated by the following method.

UV integrated luminous energy ($mJ/cm^2$)=UV intensity ($mW/cm^2$)×irradiation time (sec)

As a light source that emits ultraviolet rays, for example, a high-pressure mercury lamp or a low-pressure mercury lamp can be suitably used. These light sources are preferable because they can stably emit ultraviolet rays having a suitable wavelength with little attenuation due to the irradiation distance, and can easily and uniformly irradiate the entire surface.

<Process Cartridge and Electrophotographic Image Forming Apparatus>

The cleaning blade can be used by incorporating it into a process cartridge that is configured to be detachably attachable to the electrophotographic image forming apparatus. Specifically, the cleaning blade according to the present embodiment can be used in, for example, a process cartridge including an image bearing member as a member to be cleaned and a cleaning blade arranged so that the surface of the image bearing member can be cleaned. Such a process cartridge contributes to the stable formation of high-quality electrographic images.

Further, an electrophotographic image forming apparatus according to one aspect of the present disclosure includes an image bearing member such as a photosensitive member and a cleaning blade arranged so that the surface of the image bearing member can be cleaned, and the cleaning blade is the cleaning blade of present embodiment. Such an electrophotographic image forming apparatus can stably form high-quality electrophotographic images.

EXAMPLES

The present disclosure will be described below with reference to Production Examples, Examples and Comparative Examples, but the present disclosure is not limited to these Examples. Reagents or industrial chemicals were used as raw materials other than those shown in Examples and Comparative Examples.

In the Examples, the integrally molded cleaning blade shown in FIG. 1 was produced and evaluated. The formulations and evaluation results of each Example are shown in Tables 1 to 4.

Example 1

[Support Member]

A galvanized steel sheet with a thickness of 1.6 mm was prepared and processed to obtain a support member having an L-shaped cross section as shown by reference numeral 3 in FIG. 2.

A urethane-metal single-layer adhesive (trade name; CHEMLOK 219, manufactured by LORD Corporation) was applied to the portion of the support member that is to be in contact with the elastic member.

[Preparation of Raw Materials for Elastic Member]

A prepolymer having an NCO amount of 10.0% by mass was obtained by reacting the following components at 80° C. for 3 h:

353.6 g of 4,4'-diphenylmethane diisocyanate (trade name: MILLIONATE MT, manufactured by Tosoh Corporation) (hereinafter referred to as 4,4'-MDI), and 10.0 g of polymeric MDI (trade name: MILLIONATE MR-400, manufactured by Tosoh Corporation) (hereinafter referred to as MR400) as the isocyanate, and 636.4 g of butylene adipate polyester polyol (trade name: NIPPOLLAN 3027, manufactured by Tosoh Corporation) (hereinafter referred to as PBA2500) having a number average molecular weight of 2500 as the polyol.

Subsequently, as the curing agent, 7.1 g of 1,4-butanediol (manufactured by Tokyo Chemical Industry Co., Ltd.) (hereinafter referred to as 1,4-BD), 27.1 g of glycerin (manufactured by Tokyo Chemical Industry Co., Ltd.), 250.9 g of hexylene adipate polyester polyol with a number average molecular weight of 1000 (trade name: NIPPOLLAN 164, manufactured by Tosoh Corporation) (hereinafter referred to as PHA1000), 0.13 g of Polycat 46 (trade name, manufactured by Air Products Japan, Inc.), and 0.55 g of N,N'-dimethylhexanolamine (trade name: KAOLIZER No. 25, manufactured by Kao Corporation) (hereinafter referred to as No. 25) were mixed to prepare the curing agent.

A polyurethane elastomer composition was obtained by adding and mixing this mixture (curing agent) to the aforementioned prepolymer.

The adhesive application portion of the support member was arranged so as to protrude into the cavity of a cleaning blade molding die. Then, the polyurethane elastomer composition was injected into the cleaning blade molding die, cured at 130° C. for 2 min, and then demolded to obtain an integrally molded body of the polyurethane and the support member.

The die was coated with a mold release agent A before injecting the polyurethane elastomer composition. The release agent A was a mixture of 5.06 g of ELEMENT14 PDMS 1000-JC (trade name, manufactured by Momentive Performance Materials Inc.), 6.19 g of ELEMENT14 PDMS 10K-JC (trade name, manufactured by Momentive Performance Materials Inc.), 3.75 g of SR1000 (trade name, manufactured by Momentive Performance Materials Inc.), and 85 g of EXXSOL DSP145/160.

This integrally molded body was cut, as appropriate, so that the edge angle was 90 degrees and the distances in the lateral direction, thickness direction and longitudinal direction of polyurethane were 7.5 mm, 1.8 mm and 240 mm, respectively. The obtained cleaning blade was evaluated by the following methods.

[Method for Measuring Elastic Modulus]

The elastic modulus determined by SPM was measured by the following method. As the scanning probe microscope (SPM), MFP-3D-Origin (Oxford Instruments Co., Ltd.) was used.

A method for preparing the measurement sample was as follows.

Assuming that a line segment having a distance of 10 μm from the tip-side edge and a length L was drawn on the tip surface of the obtained cleaning blade in parallel with the tip-side edge, three 2 mm square measurement samples that had each of the points P0, P1, and P2 as the center of gravity at a distance of ⅛L, ½L, and ⅞L from one end side on the line segment and had one side parallel to the line segment were cut out. Next, 100 μm square polyurethane slices that had a thickness of 1 μm, P0, P1, and P2 as the center of gravity, and one side parallel to the line segment were cut out at −50° C. from each measurement sample by using a cryomicrotome (UC-6 (product name), manufactured by Leica Microsystems, Inc.). In this way, three measurement samples were prepared. Each of the obtained measurement samples was placed on a smooth silicon wafer and allowed to stand in an environment of room temperature 25° C. and humidity 50% for 24 h.

Next, the silicon wafer on which the measurement sample was placed was set on an SPM stage, and SPM observation was performed. The spring constant and proportionality constant (inverse constant) of a silicon cantilever (trade name: OMCL-AC160, manufactured by Olympus Corporation, tip radius of curvature: 8 nm) were checked in advance by a thermal noise method on the present SPM device and the following values were obtained (spring constant: 30.22 nN/nm, proportionality constant (inverse constant): 82.59 nm/V).

In addition, the cantilever was tuned in advance, and the resonance frequency of the cantilever was obtained (285 KHz (first order) and 1.60 MHz (higher order)).

The SPM measurement mode was set to an AM-FM mode, the free amplitude of the cantilever was set to 3 V (first order) and 25 mV (higher order), the setpoint amplitude was set to 2 V (first order), scanning was performed under the conditions of a scan speed of 1 Hz and the number of scan points of 256 in the vertical direction and 256 in the horizontal direction in a 70 μm×70 μm square visual field, and a phase image was obtained. The visual field position was selected such that P0, P1 and P2 of each measurement sample were present in the center of the visual field and one side was parallel to the line segment.

From the obtained phase image, locations where the elastic modulus was to be measured by force curve measurement were designated in the measurement sample. That is, 70 points centered on each of P0, P1 and P2 on the line segment were designated on the line segment at a pitch (interval) of 1 μm.

After that, the force curve measurement in a contact mode was performed once at all points. The force curve was acquired under the following conditions.

In force curve measurement, a piezo element, which is the drive source of the cantilever, is controlled to retract when the deflection reaches a certain value a result of the cantilever tip coming into contact with the sample surface. The retraction point at this time is called a trigger value and indicates the degree of voltage increase from the deflection voltage at the start of the force curve at which the cantilever is retracted.

In this measurement, the force curve measurement was performed with the trigger value set to 0.2 V. As other force curve measurement conditions, the distance from the tip position of the cantilever in the standby state to the point of retraction of the cantilever at the trigger value was set to 500 nm, and the scanning speed was set to 1 Hz (the speed at which the probe reciprocates once).

After that, the obtained force curves were fitted one by one based on the Hertz theory, and the elastic modulus was calculated.

The elastic modulus (Young's modulus) according to the Hertz theory is calculated by the following formula (*1).

$$F=(4/3)E^{*}R^{1/2}d^{3/2} \quad \text{Calculation formula (*1)}$$

Here, F is the force applied to the sample by the cantilever at the time of cantilever retraction, E* is the composite elastic modulus, R is the radius of curvature (8 nm) of the cantilever tip, and d is the amount of sample deformation at the time of cantilever retraction.

Here, d is calculated from the following formula (*2).

$$d=\Delta z-D \quad \text{Calculation formula (*2)}$$

Δz is the displacement amount of the piezo element from the time when the cantilever tip comes into contact with the sample until the cantilever is retracted, and D is the amount of warpage of the cantilever at the time when the cantilever is retracted.

Here, D is calculated from the following formula (*3).

$$D=\alpha\cdot\Delta V_{deflection} \quad \text{Calculation formula (*3)}$$

In the calculation formula (*3), α represents the proportionality constant (inverse constant) of the cantilever, and $\Delta V_{deflection}$ represents the amount of change in the deflection voltage from the start of contact of the cantilever with the sample to the retraction point.

Furthermore, F is calculated by the following formula (*4).

$$F=\kappa\cdot D \quad \text{Calculation formula (*4)}$$

κ is the spring constant of the cantilever.

Since $\Delta V_{deflection}$ and Δz are actually measured values, E* in the calculation formula (*1) can be obtained from the calculation formulas (*1) to (*4).

Further, the elastic modulus (Young's modulus) Es to be obtained can be calculated from the following formula (*5).

$$1/E^*=[(1-Vs^2)/Es]-[(1-Vi^2)/Ei] \quad \text{Calculation formula (*5)}$$

Vs: Poisson's ratio of the sample (fixed at 0.33 in this example)

Vi: Poisson's ratio of the cantilever tip (in this example, the value for silicon is used)

Ei: Young's modulus of the cantilever tip (in this example, the value for silicon is used)

The elastic modulus was taken as the average value of the elastic modulus values calculated from the force curves of 70 points at 3 locations, that is, 210 points in total. In addition, the coefficient of variation was calculated from the average value of the elastic modulus values of 210 points in total and the standard deviation. The calculated values are shown in Table 1.

[Method for Measuring the Size and Number of Hard Segments]

A measurement sample was prepared in the same manner as in the method for preparing the measurement sample described in the above method for measuring the elastic modulus. Further, three phase images (256 grayscale images) were acquired in the same manner as in the method described in the above method for measuring the elastic modulus, except that the size of the visual field was set to 1 μm×1 μm.

Figure 11A:
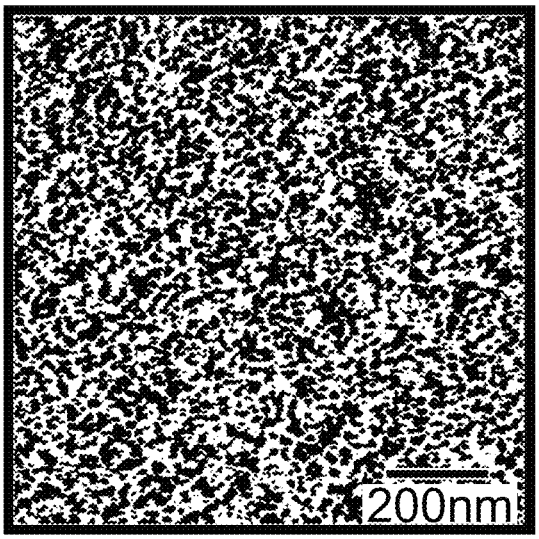
FIG. 11A shows a binarized image obtained from the elastic member according to Example 1.

Each of the obtained phase images was binarized using an image processing analysis system (trade name: Luzex-AP, manufactured by Nireco Corporation). Specifically, the phase image was binarized using the binarization setting function of the image processing analysis system. The threshold value in the binarization setting function was set to 85 (85th of 256 gradations). By this operation, a binarized image was obtained in which soft segments were shown in black and hard segments were shown in white. FIG. 11A shows one of the binarized images obtained from the elastic member according to Example 1.

Next, the number and size of hard segments in the obtained binarized image were measured using the above image processing analysis system. The number of hard segments was measured using a "number of particles" parameter, and the size of hard segments was measured using a "circle-equivalent diameter" parameter.

The ratio [(S2/S1)×100] of the number (S2) of hard segments having a circle-equivalent diameter of not more than 40 nm to the total number (S1) of hard segments was calculated in each of three square observation regions on the tip surface that had P0, P1 and P2 as the centers of gravity, a length of one side of 1 μm and one side parallel to the linear segment, and the results obtained are shown in Table 1.

[Method for Measuring Martens Hardness]

Martens hardness can be measured by the following method.

Assuming that a line segment having a distance of 10 μm from the edge is drawn on the tip surface of the elastic member in parallel with the edge, the length of the line segment is denoted by L, and the Martens hardness at the point P1 at ½L from one end side of the line segment is denoted by HM1.

Further, when it is assumed that a bisector of an angle formed by the main surface and the tip surface is drawn on a cross section including the P1 and orthogonal to the tip surface and the tip-side edge, the Martens hardness of the elastic member measured at a position on the bisector at a distance of 500 μm from the tip-side edge is denoted by HM2 (see FIG. 6).

The numerical values of |HM1-HM2| are shown in Table 1.

Microhardness tester: manufactured by Shimadzu Corporation, model: DUH-211S

Measurement environment: 23±5° C.

Measurement indenter: triangular pyramid indenter 115° (ridge angle 115°)

Measurement mode: depth setting test

Depth setting: 2 μm

Load speed: 0.03 mN/s

Holding time: 5 s $$\text{Martens hardness}=1000F/26.43h^2[\text{N/mm}^2] \quad \text{Calculation formula}$$

F: test force (mN), h: pushing depth (μm)

[Method for Measuring Polymeric MDI, 4,4'-MDI, and Isocyanurate Form of 4,4'-MDI]

The measurement was performed by a direct sample introduction method (DI method) in which a sample was introduced directly into the ion source without passing through a gas chromatograph (GC).

The device used was POLARIS Q manufactured by Thermo Fisher Scientific Inc., and Direct Exposure Probe (DEP) was used.

Assuming that a line segment having a distance of 0.5 mm from the tip-side edge was drawn on the tip surface in parallel with the tip-side edge, the polyurethane was scraped off with a biocutter from points at a distance of ⅛L', ½L', and ⅞L' (called P0', P1', and P2', respectively) from one end side on the line segment, L' being the length of the line segment. Approximately 0.1 μg of the sample sampled at each of the P0', P1' and P2' was fixed to a filament located at a probe tip and inserted directly into an ionization chamber. Then, rapid heating was performed from room temperature to 1000° C. at a constant temperature rise rate (10° C./s), and the vaporized gas was detected by a mass spectrometer.

The sum of integrated intensities of all peaks in the obtained total ion current thermogram was taken as the detection amount M1 of all ions,

- the integrated intensity of a peak of an extracted ion thermogram corresponding to an m/z value in the range of 380.5 to 381.5 derived from the polymeric MDI was denoted by M2,
- the integrated intensity of a peak of the extracted ion thermogram corresponding to an m/z value in the range of 249.5 to 250.5 derived from 4,4'-MDI was denoted by M3, and
- the integrated intensity of a peak of the extracted ion thermogram corresponding to an m/z value in the range of 749.5 to 750.5 derived from the isocyanurate form of 4,4'-MDI was denoted by M4, and M2/M1, M3/M1, and M4/M1 were calculated. The arithmetic mean values of the numerical values obtained in each of the P0', P1', and P2' were taken as the M2/M1 value, M3/M1 value, and M4/M1 value in the present disclosure.

[Method for Measuring Type and Concentration of Trifunctional Alcohol]

Trifunctional alcohol was detected by thermal decomposition GC/MS. The measurement conditions are shown below.

Sampling position: assuming that a line segment having a distance of 0.5 mm from the tip-side edge was drawn on the tip surface in parallel with the tip-side edge, the polyurethane was scraped off with a biocutter from points at a distance of ⅛L', ½L', and ⅞L' (called P0', P1', and P2', respectively) from one end side on the line segment, L' being the length of the line segment.

The samples sampled in each of the P0', P1', and P2' were measured by the following method. Then, the arithmetic mean value of the numerical values obtained in each of the samples of P0', P1', and P2' was taken as the measured value in the present disclosure.

Devices:

Pyrolysis device: product name: EGA/PY-3030D, manufactured by Frontier Laboratories Ltd.

Gas chromatograph: TRACE1310 gas chromatograph, manufactured by Thermo Fisher Scientific Inc.

Mass spectrometer: ISQLT, manufactured by Thermo Fisher Scientific Inc.

Pyrolysis temperature: 500° C.

GC column: inner diameter 0.25 mm×30 m, stainless steel capillary column fixed phase: 5% phenylpolydimethylsiloxane Temperature rise conditions: the temperature is held at 50° C. for 3 min and raised to 300° C. at 8° C./min MS condition: mass number range m/z 10 to 650

Scan speed: 1 sec/scan

The type of trifunctional alcohol is qualitative in GC/MS. A calibration curve was prepared by GC analysis of the known concentration of the trifunctional alcohol type that was determined qualitatively, and quantification was performed from the GC peak area ratio.

<Measurement of DSC>

DSC measurement was performed using a differential scanning calorimeter (trade name: TGA/DSC3+, manufactured by Mettler-Toledo, LLC) according to the Testing methods for transition temperature of plastics of Japanese Industrial Standards (JIS) K7121.

At this time, 5.0 mg of the sample was weighed in an aluminum pan, the temperature was raised from room temperature to 80° C. at a temperature rise rate of 10° C./min, then annealing was performed for 4 h, cooling to 10° C. was performed at 5° C./min, and then the temperature was raised from 10° C. to 250° C. at a temperature rise rate of 10° C./min.

The peak top temperature of the endothermic peak was calculated from the differential curve obtained by differentiating the obtained DSC curve. For the melting start temperature, the temperature of the intersection of a straight line obtained by extending the baseline on the low-temperature side of the endothermic peak to the high-temperature side and the tangent line drawn at the point where the gradient was maximized on the curve on the low-temperature side of the endothermic peak was calculated.

Assuming that a line segment having a distance of 0.5 mm from the tip-side edge was drawn on the tip surface of the sample in parallel with the tip-side edge, the length of the line segment was denoted by L', points at a distance of ⅛L', ½L', and ⅞L' from one end side on the line segment were denoted by P0', P1', and P2', respectively, and samples were sampled at each of the P0', P1', and P2'. Then, the arithmetic mean value of the numerical values obtained in each of the samples of P0', P1', and P2' was used as the measured value in the present disclosure.

<Method for Producing Toner 1>

In the following, all "parts" are based on mass unless otherwise specified.

(Step for Preparing Aqueous Medium 1)

A total of 14.0 parts of sodium phosphate (12-hydrate, manufactured by Rasa Industries, Ltd.) was put into 650.0 parts of ion-exchanged water in a reaction vessel equipped with a stirrer, a thermometer, and a reflux tube, and the temperature was held at 65° C. for 1.0 h while purging with nitrogen.

A calcium chloride aqueous solution in which 9.2 parts of calcium chloride (dihydrate) was dissolved in 10.0 parts of ion-exchanged water was batched while stirring at 15,000 rpm by using T. K. Homomixer (manufactured by Tokushu Kagaku Kogyo Co., Ltd.), and an aqueous medium including a dispersion stabilizer was prepared. Further, 10% by mass of hydrochloric acid was added to the aqueous medium to adjust the pH to 5.0 and obtain an aqueous medium 1.

(Step for Preparing Polymerizable Monomer Composition)

Styrene: 60.0 parts

C. I. Pigment Blue 15:3:6.5 parts

The materials were put into an attritor (manufactured by Mitsui Miike Machinery Co., Ltd.) and further dispersed using zirconia particles having a diameter of 1.7 mm at 220 rpm for 5.0 h to prepare a pigment-dispersed liquid. The following materials were added to the pigment-dispersed liquid.

Styrene: 20.0 parts n-Butyl acrylate: 20.0 parts

Crosslinking agent (divinylbenzene): 0.3 parts

Saturated polyester resin: 5.0 parts (Polycondensate of propylene oxide-modified bisphenol A (2 molar adduct) and terephthalic acid (molar ratio 10:12), glass transition temperature Tg=68° C., weight average molecular weight Mw=10000, molecular weight distribution Mw/Mn=5.12)

Fischer-Tropsch wax (melting point 78° C.): 7.0 parts

The resulting composition was kept warm at 65° C. and uniformly dissolved and dispersed at 500 rpm using T. K. Homomixer (manufactured by Tokushu Kagaku Kogyo Co., Ltd.) to prepare a polymerizable monomer composition.

(Granulation Step)

The temperature of the aqueous medium 1 was set to 70° C., the polymerizable monomer composition was charged into the aqueous medium 1 while maintaining the rotation speed of the T. K. Homomixer at 15,000 rpm, and 10.0 parts of t-butylperoxypivalate as a polymerization initiator was added. Granulation was carried out for 10 min while maintaining 15,000 rpm with the stirring device as it was.

(Polymerization/Distillation Step)

After the granulation step, the stirrer was replaced with a propeller stirring blade, and the polymerization was carried out at 70° C. for 5.0 h while stirring at 150 rpm, the temperature was raised to 85° C., and heating was performed for 2.0 h to carry out the polymerization reaction.

After that, the reflux tube of the reaction vessel was replaced with a cooling tube, and the slurry was heated to 100° C. to carry out distillation for 6 h to distill off the unreacted polymerizable monomer to obtain a toner mother particle-dispersed solution.

(Polymerization of Organosilicon Compound)

A total of 60.0 parts of ion-exchanged water was weighed in a reaction vessel equipped with a stirrer and a thermometer, and the pH was adjusted to 4.0 using 10% by mass hydrochloric acid. This was heated with stirring to bring the temperature to 40° C.

After that, 40.0 parts of methyltriethoxysilane, which is an organosilicon compound, was added followed by stirring for at least 2 h for hydrolysis. The end point of the hydrolysis was visually confirmed by that the oil and water did not separate and became one layer, and the mixture was cooled to obtain an organosilicon compound hydrolysate.

After cooling the obtained toner mother particle-dispersed solution to a temperature of 55° C., 25.0 parts of the organosilicon compound hydrolyzate was added to start the polymerization of the organosilicon compound. After holding for 15 min, the pH was adjusted to 5.5 with a 3.0% by mass aqueous sodium hydrogen carbonate solution. After holding for 60 min while continuing stirring at 55° C., the pH was adjusted to 9.5 using a 3.0% by mass sodium hydrogen carbonate aqueous solution, followed by further holding for 240 min to obtain a toner particle-dispersed solution.

(Washing and Drying Step)

After completion of the polymerization step, the toner particle-dispersed solution was cooled, hydrochloric acid was added to the toner particle-dispersed solution, the pH was adjusted to not more than 1.5, the mixture was stirred for 1 h, and then solid-liquid separation was performed with a pressure filter to obtain the toner cake. This was reslurried with ion-exchanged water to form a dispersion liquid again, and then solid-liquid separation was performed with the above-mentioned filter to obtain a toner cake.

The obtained toner cake was dried in a thermostat at 40° C. for 72 h and classified to obtain a toner 1.

<Evaluation of Cleaning Performance>

The cleaning blade 1 was incorporated into a cyan cartridge of a color laser beam printer (trade name: HP LaserJet Enterprise Color M553dn, manufactured by Hewlett-Packard Co.) as a cleaning blade for a photosensitive drum to be cleaned.

Further, the toner of the developing device of the cyan cartridge was completely replaced with the toner 1 described above.

Then, after allowing the printer to stand for 24 h in a low-temperature and-low humidity environment (temperature 15° C., relative humidity 10%), images were formed on 12,500 sheets, which was the number of printable sheets, under the same environment (hereinafter, called "normal evaluation").

Further, the developing device used was replaced with a developing device of a new cyan cartridge in which all the toner was replaced with the toner 1, and images were formed again on 12,500 sheets, which was the number of printable sheets (hereinafter referred to as "double evaluation").

Further, the evaluation was performed by opening a hole in the back of the cartridge and sucking out the waste toner as appropriate. The performance of the obtained images was ranked according to the following evaluation criteria.

A: Image defects (streaks on the image) caused by the cleaning blade did not occur in either normal evaluation or double evaluation.

B: Image defects (streaks on the image) caused by the cleaning blade did not occur in normal evaluation and very slightly occurred in double evaluation (streak length is not more than 5 mm).

C: Image defects (streaks on the image) caused by the cleaning blade did not occur in normal evaluation, but occurred slightly in double evaluation (streak length exceeds 5 mm but is not more than 10 mm).

D: Image defects (streaks on the image) caused by the cleaning blade did not occur in the normal evaluation, but occurred in the double evaluation (more than 10 mm).

E: Image defects (streaks on the image) caused by the cleaning blade occurred in both normal evaluation and double evaluation.

<Evaluation of Edge Chipping of Cleaning Blade>

After the above cleaning performance evaluation was completed (double evaluation), the cleaning blade was removed from the cartridge and observed under a 1000-times magnification with a digital microscope (trade name: main unit VHX-5000, lens VH-ZST, manufactured by Keyence Corporation).

Figure 9:
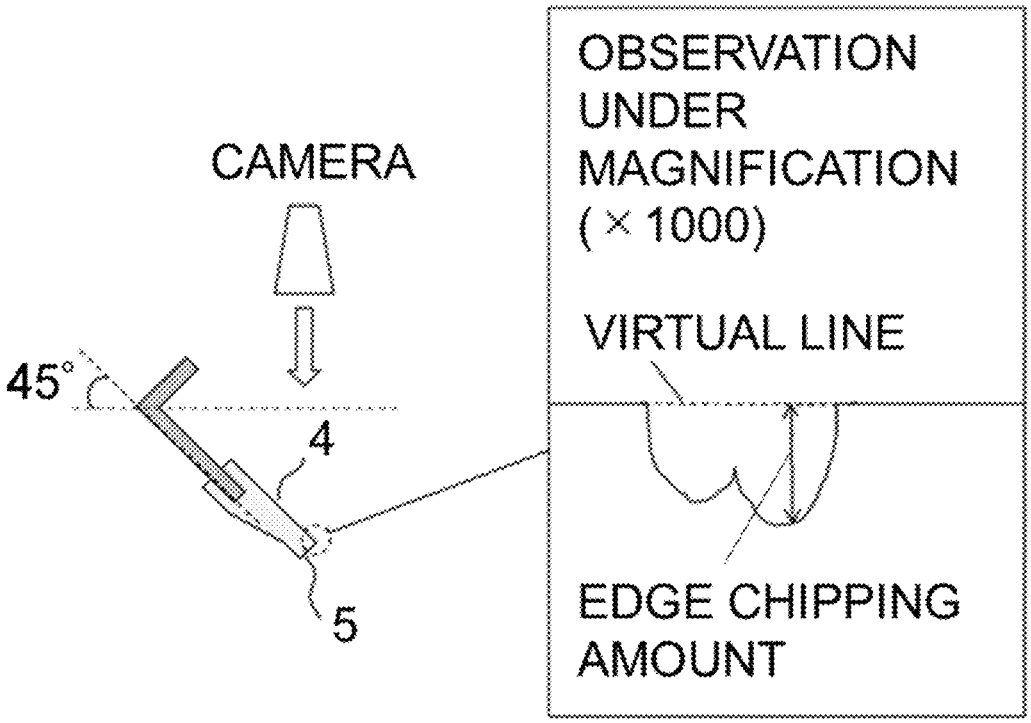
FIG. 9 illustrates a method of measuring edge chipping.
Figure 10:
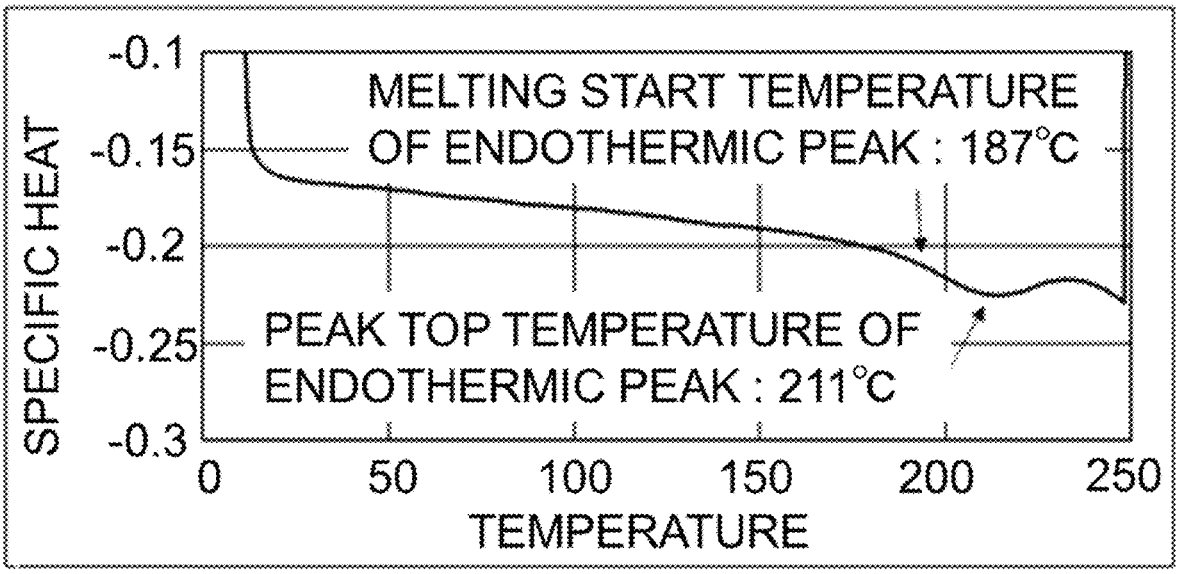
FIG. 10 is a DSC chart obtained by differential scanning calorimetry and related to an elastic member of the electrophotographic cleaning blade according to one aspect of the present disclosure.

The tip of the main surface of the elastic member of the cleaning blade was used as the observation surface, and as shown in FIG. 9, the support member was installed at an angle of 45° so that the support member was on the upper side and the tip of the elastic member was on the lower side, and the whole area in the longitudinal direction was observed. As shown in the partially enlarged view of FIG. 9, the maximum value of the distance in the lateral direction of the edge chipped portion was measured as the "edge chipped amount", and the performance was ranked according to the following evaluation criteria.

$A^+$: Edge chipping did not occur.

A: The amount of edge chipping was less than 0.5

B: The amount of edge chipping was at least 0.5 μm and less than 1

C: The amount of edge chipping was at least 1 μm and less than 3

D: The amount of edge chipping was at least 3

<Comprehensive Evaluation>

Based on the rank of the image evaluation of the cleaning performance and the rank of the evaluation result of the edge chipping evaluation of the cleaning blade, the comprehensive evaluation was performed as follows.

A: The evaluation result was a combination of $A/A^+$, A/A, A/B, B/A, and $B/A^+$. There was no problem in actual use.

B: The evaluation result was a combination of A/C, C/A, $C/A^+$, B/B, B/C, and C/B. There was no problem in actual use.

C: The evaluation result was a combination of C/C.

D: There was no E in the evaluation result, but there was one or more D.

E: There was one or more E in the evaluation result.

Example 2

The process was the same as in Example 1, except that 345.5 g of 4,4'-MDI and 20.0 g of MR400 were used as the isocyanate, 634.5 g of PBA2500 was used as the polyol, and 10.7 g of 1,4-BD, 26.9 g of glycerin, and 275.7 g of PHA1000 were used as the curing agent, and the cleaning property was evaluated also with respect to the normal toner of the commercial developing device.

Example 3

The process was the same as in Example 1, except that 345.5 g of 4,4'-MDI and 20.0 g of MR400 were used as the isocyanate, 634.5 g of PBA2500 was used as the polyol, and 7.0 g of 1,4-BD, 42.2 g of glycerin, and 302.7 g of PHA1000 were used as the curing agent.

Example 4

The process was the same as in Example 1, except that 334.6 g of 4,4'-MDI and 40.0 g of MR400 were used as the isocyanate, 625.4 g of PBA2500 was used as the polyol, the amount of NCO was 10.2% by mass, and 10.9 g of 1,4-BD, 27.5 g of glycerin, and 281.2 g of PHA1000 were used as the curing agent.

Example 5

The process was the same as in Example 4, except that 301.9 g of 4,4'-MDI and 80.0 g of MR400 were used as the isocyanate, 618.1 g of PBA2500 was used as the polyol, and 11.6 g of 1,4-BD, 29.4 g of glycerin, and 301.3 g of PHA1000 were used as the curing agent.

Example 6

The process was the same as in Example 5, except that 10.9 g of 1,4-BD, 27.5 g of glycerin, and 281.2 g of PHA1000 were used as the curing agent.

Example 7

The process was the same as in Example 4, except that 269.2 g of 4,4'-MDI and 120.0 g of MR400 were used as the isocyanate, 610.8 g of PBA2500 was used as the polyol, and 13.8 g of 1,4-BD, 27.7 g of glycerin, and 304.4 g of PHA1000 were used as the curing agent.

Example 8

The process was the same as in Example 7, except that 4.1 g of 1,4-BD, 45.6 g of glycerin, and 364.5 g of PHA1000 were used as the curing agent.

Example 9

The process was the same as in Example 7, except that 10.9 g of 1,4-BD, 27.5 g of glycerin, and 281.2 g of PHA1000 were used as the curing agent.

Example 10

The process was the same as in Example 7, except that 1,4-BD was not used and 35.9 g of glycerin and 263.5 g of PHA1000 were used as the curing agent.

Example 11

The process was the same as in Example 10, except that 30.8 g of glycerin and 225.9 g of PHA1000 were used as the curing agent.

Example 12

The process was the same as in Example 10, except that glycerin was not used and 50.3 g of trimethylolpropane (manufactured by Tokyo Chemical Industry Co., Ltd.) (hereinafter referred to as TMP) and 285.0 g of PHA1000 were used as the curing agent.

Example 13

The process was the same as in Example 12, except that 241.4 g of 4,4'-MDI and 150.0 g of polymeric MDI (trade name: MILLIONATE MR-200, manufactured by Tosoh Corporation) (hereinafter referred to as MR200) were used as the isocyanate, 608.6 g of PBA2500 was used as the polyol, and 50.3 g of TMP and 285.0 g of PHA1000 were used as the curing agent.

Example 14

The process was the same as in Example 12, except that 220.2 g of 4,4'-MDI and 180.0 g of MR400 were used as the isocyanate, 599.8 g of PBA2500 was used as the polyol, and 50.3 g of TMP and 285.0 g of PHA1000 were used as the curing agent.

Example 15

The process was the same as in Example 14, except that 57.5 g of TMP and 325.7 g of PHA1000 were used as the curing agent.

Example 16

The process was the same as in Example 14, except that 61.1 g of TMP and 346.1 g of PHA1000 were used as the curing agent.

Example 17

The process was the same as in Example 16, except that PHA1000 as the curing agent was replaced with butylene adipate polyester polyol having a number average molecular weight of 1000 (trade name: NIPPOLLAN 4009, manufactured by Tosoh Corporation) (hereinafter referred to as PBA1000).

Example 18

The process was the same as in Example 16, except that 217.5 g of 4,4'-MDI and 180.0 g of MR400 were used as the isocyanate, and PBA2500 as the polyol was replaced with 602.5 g of hexylene adipate polyester polyol having a number average molecular weight of 2600 (trade name: NIPPOLLAN 136, manufactured by Tosoh Corporation) (may be also referred to as PHA2600).

Example 19

The process was the same as in Example 18, except that PHA1000 as the curing agent was replaced with PBA1000.

Example 20

The process was the same as in Example 16, except that 236.5 g of 4,4'-MDI and 180.0 g of MR400 were used as the isocyanate, 583.5 g of PBA2500 was used as the polyol, the amount of NCO was 10.8% by mass, and 64.7 g of TMP and 366.4 g of PHA1000 were used as the curing agent.

Example 21

The process was the same as in Example 16, except that 191.1 g of 4,4'-MDI and 210.0 g of MR200 were used as the isocyanate, 598.9 g of PBA2500 was used as the polyol, and 61.1 g of TMP and 346.1 g of PHA1000 were used as the curing agent.

Example 22

The process was the same as in Example 16, except that 187.5 g of 4,4'-MDI and 220.0 g of MR400 were used as the isocyanate, 592.5 g of PBA2500 was used as the polyol, and 57.5 g of TMP and 325.7 g of PHA1000 were used as the curing agent.

Example 23

The process was the same as in Example 22, except that 163.0 g of 4,4'-MDI and 250.0 g of MR400 were used as the isocyanate, and 587.0 g of PBA2500 was used as the polyol.

Example 24

The process was the same as in Example 22, except that 50.3 g of TMP and 285.0 g of PHA1000 were used as the curing agent.

Example 25

The process was the same as in Example 24, except that 63.8 g of TMP and 255.3 g of PHA1000 were used as the curing agent.

Example 26

The process was the same as in Example 4, except that the adhesive was a one-component adhesive (trade name: METALOC UA, manufactured by Toyo Kagaku Kenkyusho Co., Ltd.) for injected urethane resins and metals.

Example 27

The process was the same as in Example 4, except that the release agent B was used. The release agent B was a mixture of 4.05 g of ELEMENT14 PDMS 1000-JC (trade name, manufactured by Momentive Performance Materials Inc.), 4.95 g of ELEMENT14 PDMS 10K-JC (trade name, manufactured by Momentive Performance Materials Inc.), 6.00 g of SR1000 (trade name, manufactured by Momentive Performance Materials Inc.), and 85 g of EXXSOL DSP145/160.

Example 28

The process was the same as in Example 27, except that the adhesive was a one-component adhesive (trade name: METALOC UA, manufactured by Toyo Kagaku Kenkyusho Co., Ltd.) for injected urethane resins and metals.

Example 29

The process was the same as in Example 4, except that the release agent C was used. The release agent C was a fluororesin-containing metal release agent (trade name: Fluoro Surf FG-5093F130-0.5, manufactured by Fluoro Technology Co., Ltd.). The release agent was coated on a die at 130° C. and dried before the urethane composition was injected.

Example 30

The process was the same as in Example 29, except that the adhesive was a one-component adhesive (trade name: METALOC UA, manufactured by Toyo Kagaku Kenkyusho Co., Ltd.) for injected urethane resins and metals.

Example 31

The process was the same as in Example 3, except that the cleaning blade obtained in Example 3 was irradiated with ultraviolet rays for 15 sec and the surface was treated with an integrated ultraviolet luminous energy of 492 mJ/cm$^2$ by using an ultraviolet irradiation treatment device having an ultraviolet ray intensity of 32.8 mW/cm$^2$.

The light source of the ultraviolet irradiation treatment device was a low-pressure mercury ozone-less lamp (manufactured by Toshiba Lighting & Technology Corporation) using titanium oxide-containing quartz glass having a maximum emission peak of 254 nm.

Example 32

The process was the same as in Example 31, except that the cleaning blade obtained in Example 7 was irradiated with ultraviolet rays for 60 sec and the surface was treated with an integrated ultraviolet luminous energy of 1968 mJ/cm$^2$ by using the ultraviolet irradiation treatment device having an ultraviolet ray intensity of 32.8 mW/cm$^2$.

Example 33

The process was the same as in Example 31, except that the cleaning blade obtained in Example 25 was irradiated with ultraviolet rays for 120 sec and the surface was treated with an integrated ultraviolet luminous energy of 3936 mJ/cm$^2$ by using the ultraviolet irradiation treatment device having an ultraviolet ray intensity of 32.8 mW/cm$^2$.

Comparative Example 1

Figure 11B:
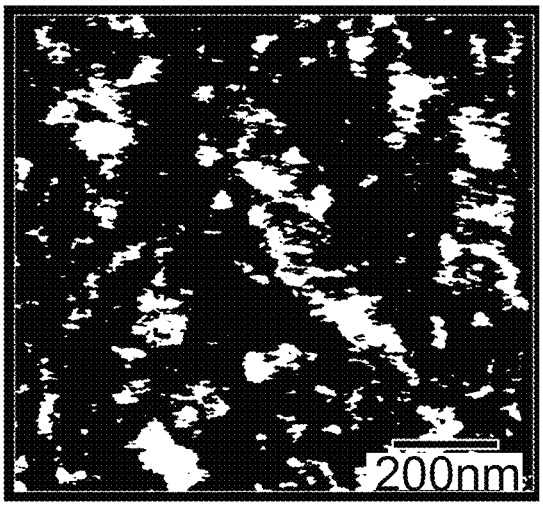
FIG. 11B is a binarized image obtained from the elastic member according to Comparative Example 1.

The process was the same as in Example 1, except that 334.7 g of 4,4'-MDI was used as the isocyanate, 665.3 g of PBA2500 was used as the polyol, and 19.4 g of 1,4-BD, 15.5 g of glycerin, and 159.0 g of PBA1000 were used as the curing agent. The binarized image obtained from the elastic member according to Comparative Example 1 is shown in FIG. 11B.

Comparative Example 2

The process was the same as in Comparative Example 1, except that the cleaning blade obtained in Comparative Example 1 was irradiated with ultraviolet rays for 150 sec and the surface was treated with an integrated ultraviolet luminous energy of 4920 mJ/cm$^2$ by using the ultraviolet irradiation treatment device having an ultraviolet ray intensity of 32.8 mW/cm$^2$.

Comparative Example 3

A cleaning blade was obtained in the same manner as in Example 1, except that 296.6 g of 4,4'-MDI was used as the isocyanate, 703.4 g of butylene adipate polyester polyol having a number average molecular weight of 2000 (trade name: NIPPOLLAN 4010, manufactured by Tosoh Corporation) (hereinafter referred to as PBA2000) was used as the polyol, 62.0 g of 1,4-BD and 15.5 g of glycerin were used as the curing agent, and 0.23 g of No. 25 was used as the catalyst (Polycat 46 was not added). The cleaning blade was secondarily cured at 130° C. for 60 min, then 2 mm of the tip of the elastic member was immersed for 3 min in 4,4'-MDI melted at 80° C., and then 4,4'-MDI adhering to the blade surface was cleaned with butyl acetate. Then, aging was performed for 24 h to obtain a surface-treated cleaning blade. The obtained cleaning blade was evaluated in the same manner as in Example 1.

Comparative Example 4

The process was the same as in Comparative Example 1, except that 296.6 g of 4,4'-MDI was used as the isocyanate, 703.4 g of PBA2000 was used as the polyol, 26.5 g of 1,4-BD and 39.7 g of glycerin were used as the curing agent, 0.23 g of No. 25 was used as the catalyst (Polycat 46 was not added), and the secondary curing was performed at 130° C. for 60 min after demolding.

TABLE 1

| | | | Example 1 | Example 2 | | Example 3 | Example 4 | Example 5 | Example 6 | Example 7 | Example 8 | Example 9 | Example 10 |
|---|---|---|---|---|---|---|---|---|---|---|---|---|---|
| Compounding | Propolymer | Amount of MDI (g) | 353.6 | 345.5 | | 345.5 | 334.6 | 301.9 | 301.9 | 269.2 | 269.2 | 269.2 | 269.2 |
| | | Polymeric MDI type | MR400 | MR400 | | MR400 | MR400 | MR400 | MR400 | MR400 | MR400 | MR400 | MR400 |
| | | Amount of polymeric MDI (g) | 10.0 | 20.0 | | 20.0 | 40.0 | 80.0 | 80.0 | 120.0 | 120.0 | 120.0 | 120.0 |
| | | Polyol type | PBA2500 | PBA2500 | | PBA2500 | PBA2500 | PBA2500 | PBA2500 | PBA2500 | PBA2500 | PBA2500 | PBA2500 |
| | | Amount of polyol (g) | 636.4 | 634.5 | | 634.5 | 625.4 | 618.1 | 618.1 | 610.8 | 610.8 | 610.8 | 610.8 |
| | Curing agent | Triol type | Glycerin | Glycerin | | Glycerin | Glycerin | Glycerin | Glycerin | Glycerin | Glycerin | Glycerin | Glycerin |
| | | Amount of triol (g) | 27.1 | 26.9 | | 42.2 | 27.5 | 29.4 | 27.5 | 27.7 | 45.6 | 27.5 | 35.9 |
| | | Amount of 1,4-BDPolycat-46 (g) | 7.1 | 10.7 | | 7.0 | 10.9 | 11.6 | 10.9 | 13.8 | 4.1 | 10.9 | 0.0 |
| | | Polyol type | PHA1000 | PHA1000 | | PHA1000 | PHA1000 | PHA1000 | PHA1000 | PHA1000 | PHA1000 | PHA1000 | PHA1000 |
| | | Amount of polyol (g) | 250.9 | 275.7 | | 302.7 | 281.2 | 301.3 | 281.2 | 304.4 | 364.5 | 281.2 | 263.5 |
| | | Amount of Polycat 46 (g) | 0.13 | 0.13 | | 0.13 | 0.13 | 0.13 | 0.13 | 0.13 | 0.13 | 0.13 | 0.13 |
| | | No. 25 (g) | 0.55 | 0.55 | | 0.55 | 0.55 | 0.55 | 0.55 | 0.55 | 0.55 | 0.55 | 0.55 |
| | Post-treatment | | None | None | | None | None | None | None | None | None | None | None |
| | Adhesive | | CHEMLOK 219 | CHEMLOK 219 | | CHEMLOK 219 | CHEMLOK 219 | CHEMLOK 219 | CHEMLOK 219 | CHEMLOK 219 | CHEMLOK 219 | CHEMLOK 219 | CHEMLOK 219 |
| | Release Parting agent | | A | A | A | A | A | A | A | A | A | A | A |
| Elastic modulus | Average value (Mpa) | | 18 | 17 | | 16 | 19 | 25 | 28 | 31 | 31 | 33 | 42 |
| | Standard deviation (Mpa) | | 0.85 | 0.8 | | 0.74 | 0.78 | 0.78 | 0.88 | 0.94 | 1.12 | 1.01 | 1.29 |
| | Variation coefficient (%) | | 4.7 | 4.7 | | 4.6 | 4.1 | 3.1 | 3.1 | 3.0 | 3.6 | 3.1 | 3.1 |
| Martens hardness | Difference between surface and inside: [HM1-HM2] ($N/mm^2$) | | 0.02 | 0.02 | | 0.02 | 0.02 | 0.03 | 0.03 | 0.03 | 0.03 | 0.03 | 0.04 |
| Number of hard segments | P0 | S1 | 340 | 348 | | 345 | 471 | 637 | 642 | 756 | 642 | 745 | 944 |
| | | (S2/S1) × 100 | 93 | 94 | | 93 | 93 | 92 | 93 | 93 | 93 | 94 | 95 |
| | P1 | S1 | 352 | 343 | | 329 | 451 | 630 | 653 | 726 | 672 | 757 | 957 |
| | | (S2/S1) × 100 | 93 | 92 | | 92 | 93 | 93 | 94 | 94 | 94 | 94 | 95 |
| | P2 | S1 | 355 | 335 | | 351 | 445 | 645 | 658 | 745 | 665 | 789 | 980 |
| | | (S2/S1) × 100 | 92 | 93 | | 93 | 93 | 94 | 94 | 94 | 94 | 93 | 96 |
| Mass analysis | M2/M1 | | 0.001 | 0.001 | | 0.001 | 0.002 | 0.003 | 0.003 | 0.004 | 0 004 | 0.004 | 0.004 |
| | M3/M1 | | 0.10 | 0.09 | | 0.09 | 0.09 | 0.08 | 0.08 | 0.07 | 0.07 | 0.07 | 0.07 |
| | M4/M1 | | 0.001 | 0.001 | | 0.000 | 0.001 | 0.001 | 0.001 | 0.000 | 0.000 | 0.000 | 0.000 |
| Concentration of trifunctional alcohol (mmol/g) | | | 0.23 | 0.22 | | 0.34 | 0.23 | 0.24 | 0.23 | 0.22 | 0.35 | 0.23 | 0.30 |
| DSC endothermic peak | Melting start temperature (° C.) | | 178 | 182 | | 182 | 183 | 185 | 185 | 186 | 186 | 187 | 187 |
| | Peak top temperature (° C.) | | 208 | 210 | | 210 | 210 | 211 | 210 | 211 | 210 | 211 | 211 |
| | Difference between melting start temperature and peak top temperature (° C.) | | 30 | 28 | | 28 | 27 | 26 | 25 | 25 | 24 | 24 | 24 |
| Actual apparatus evaluation | Toner | | Toner 1 | Toner 1 | Normal Toner | Toner 1 | Toner 1 | Toner 1 | Toner 1 | Toner 1 | Toner 1 | Toner 1 | Toner 1 |
| | Cleaning property | Normal | Not occurred | Not occurred | Not occurred | Not occurred | Not occurred | Not occurred | Not occurred | Not occurred | Not occurred | Not occurred | Not occurred |
| | | Double | Slight | Slight | Slight | Slight | Slight | Very slight | Very sight | Very sight | Very slight | Very slight | Very slight |
| | | Rank A~E | C | C | C | C | C | B | B | B | B | B | B |
| | Edge chipping | Rank A~D | C | C | C | C | C | B | B | A | B | A | A |
| | Total evaluation | | C | C | C | C | C | B | B | A | B | A | A |

TABLE 2

| | | | Example 11 | Example 12 | | Example 13 | Example 14 | Example 15 | Example 16 | Example 17 | Example 18 | Example 19 | Example 20 |
|---|---|---|---|---|---|---|---|---|---|---|---|---|---|
| Compounding | Propolymer | Amount of MDI (g) | 269.2 | 269.2 | | 241.4 | 220.2 | 220.2 | 220.2 | 220.2 | 217.5 | 217.5 | 236.5 |
| | | Polymeric MDI type | MR400 | MR400 | | MR400 | MR400 | MR400 | MR400 | MR400 | MR400 | MR400 | MR400 |
| | | Amount of polymeric MDI (g) | 120.0 | 120.0 | | 150.0 | 180.0 | 180.0 | 180.0 | 180.0 | 180.0 | 180.0 | 180.0 |
| | | Polyol type | PBA2500 | PBA2500 | | PBA2500 | PBA2500 | PBA2500 | PBA2500 | PBA2500 | PBA2600 | PBA2600 | PBA2500 |
| | | Amount of polyol (g) | 610.8 | 610.8 | | 608.6 | 599.8 | 599.8 | 599.8 | 599.8 | 602.5 | 602.5 | 583.5 |
| | Curing agent | Triol type | Glycerin | TMP | | TMP | TMP | TMP | TMP | TMP | TMP | TMP | TMP |
| | | Amount of triol (g) | 30.8 | 50.3 | | 50.3 | 50.3 | 57.5 | 61.1 | 61.1 | 61.1 | 61.1 | 64.7 |
| | | Amount of 1,4-BDPolycat-46 (g) | 0.0 | 0.0 | | 0.0 | 0.0 | 0.0 | 0.0 | 0.0 | 0.0 | 0.0 | 0.0 |
| | | Polyol type | PHA1000 | PHA1000 | | PHA1000 | PHA1000 | PHA1000 | PHA1000 | PHA1000 | PHA1000 | PHA1000 | PHA1000 |
| | | Amount of polyol (g) | 225.9 | 285.0 | | 285.0 | 285.0 | 325.7 | 346.1 | 346.1 | 346.1 | 346.1 | 366.4 |
| | | Amount of Polycat 46 (g) | 0.13 | 0.13 | | 0.13 | 0.13 | 0.13 | 0.13 | 0.13 | 0.13 | 0.13 | 0.13 |
| | | No. 25 (g) | 0.55 | 0.55 | | 0.55 | 0.55 | 0.55 | 0.55 | 0.55 | 0.55 | 0.55 | 0.55 |
| | Post-treatment | | None | None | | None | None | None | None | None | None | None | None |
| | Adhesive | | CHEMLOK 219 | CHEMLOK 219 | | CHEMLOK 219 | CHEMLOK 219 | CHEMLOK 219 | CHEMLOK 219 | CHEMLOK 219 | CHEMLOK 219 | CHEMLOK 219 | CHEMLOK 219 |
| | Release Parting agent | | A | A | A | A | A | A | A | B | B | C | C |
| Elastic modulus | Average value (Mpa) | | 48 | 40 | | 41 | 50 | 46 | 43 | 43 | 42 | 42 | 45 |
| | Standard deviation (Mpa) | | 1.46 | 1.14 | | 1.19 | 1.51 | 1.37 | 1.26 | 1.42 | 1.42 | 1.25 | 1.42 |
| | Variation coefficient (%) | | 3.0 | 2.9 | | 2.9 | 3.0 | 3.0 | 2.9 | 3.3 | 3.4 | 3.0 | 3.2 |
| Martens hardness | Difference between surface and inside: [HM1-HM2] ($N/mm^2$) | | 0.06 | 0.05 | | 0.05 | 0.07 | 0.07 | 0.07 | 0.07 | 0.07 | 0.07 | 0.07 |
| Number of hard segments | P0 | S1 | 986 | 904 | | 944 | 1254 | 1245 | 978 | 978 | 978 | 978 | 1099 |
| | | (S2/S1) × 100 | 95 | 95 | | 95 | 96 | 96 | 95 | 95 | 95 | 95 | 95 |
| | P1 | S1 | 1068 | 892 | | 932 | 1263 | 1145 | 1074 | 1074 | 1074 | 1074 | 1180 |
| | | (S2/S1) × 100 | 95 | 95 | | 95 | 96 | 95 | 95 | 95 | 95 | 95 | 95 |
| | P2 | S1 | 994 | 955 | | 957 | 1365 | 1185 | 1008 | 1008 | 1008 | 1008 | 1206 |
| | | (S2/S1) × 100 | 95 | 95 | | 96 | 96 | 95 | 96 | 96 | 96 | 96 | 94 |
| Mass analysis | M2/M1 | | 0.004 | 0.004 | | 0.004 | 0.008 | 0.008 | 0.008 | 0.008 | 0.008 | 0.008 | 0.008 |
| | M3/M1 | | 0.07 | 0.07 | | 0.06 | 0.06 | 0.05 | 0.05 | 0.05 | 0.05 | 0.05 | 0.06 |
| | M4/M1 | | 0.000 | 0.000 | | 0.000 | 0.000 | 0.000 | 0.000 | 0.000 | 0.000 | 0.000 | 0.000 |
| Concentration of trifunctional alcohol (mmol/g) | | | 0.27 | 0.28 | | 0.28 | 0.28 | 0.31 | 0.32 | 0.32 | 0.32 | 0.32 | 0.34 |
| DSC endothermic peak | Melting start temperature (° C.) | | 187 | 187 | | 187 | 188 | 188 | 189 | 188 | 188 | 188 | 188 |
| | Peak top temperature (° C.) | | 211 | 213 | | 213 | 213 | 213 | 213 | 212 | 212 | 212 | 211 |
| | Difference between melting start temperature and peak top temperature (° C.) | | 24 | 26 | | 26 | 25 | 25 | 24 | 24 | 24 | 24 | 23 |
| apparatus evaluation | Toner | | Toner 1 | Toner 1 | Toner 1 | Toner 1 | Toner 1 | Toner 1 | Toner 1 | Toner 1 | Toner 1 | Toner 1 | Toner 1 |
| | Cleaning property | Normal | Not occurred | Not occurred | Not occurred | Not occurred | Not occurred | Not occurred | Not occurred | Not occurred | Not occurred | Not occurred | Not occurred |
| | | Double | Very slight | Very slight | Very slight | Not occurred | Not occurred | Not occurred | Not occurred | Not occurred | Not occurred | Not occurred | Not occurred |
| | | Rank A~E | B | B | B | A | A | A | A | A | A | A | A |
| | Edge chipping | Rank A~D | A | $A^+$ | $A^+$ | $A^+$ | $A^+$ | $A^+$ | B | B | B | $A^+$ | A |
| | Total evaluation | | A | A | A | A | A | A | A | A | A | A | A |

TABLE 3

| | | | Example 21 | Example 22 | | Example 23 | Example 24 | Example 25 | Example 26 | Example 27 | Example 28 | Example 29 | Example 30 |
|---|---|---|---|---|---|---|---|---|---|---|---|---|---|
| Compounding | Propolymer | Amount of MDI (g) | 191.1 | 187.5 | | 163.0 | 187.5 | 187.5 | 334.6 | 334.6 | 334.6 | 334.6 | 334.6 |
| | | Polymeric MDI type | MR200 | MR400 | | MR400 | MR400 | MR400 | MR400 | MR400 | MR400 | MR400 | MR400 |
| | | Amount of polymeric MDI (g) | 210.0 | 220.0 | | 250.0 | 220.0 | 220.0 | 40.0 | 40.0 | 40.0 | 40.0 | 40.0 |
| | | Polyol type | PBA2500 | PBA2500 | | PBA2500 | PBA2500 | PBA2500 | PBA2500 | PBA2500 | PBA2500 | PBA2500 | PBA2500 |
| | | Amount of polyol (g) | 589.9 | 592.5 | | 587.0 | 592.5 | 592.5 | 625.4 | 625.4 | 625.4 | 625.4 | 625.4 |
| | Curing agent | Triol type | TMP | TMP | | TMP | TMP | TMP | Glycerin | Glycerin | Glycerin | Glycerin | Glycerin |
| | | Amount of triol (g) | 61.1 | 57.5 | | 57.5 | 50.3 | 63.8 | 27.5 | 27.5 | 27.5 | 27.5 | 27.5 |
| | | Amount of 1,4-BDPolycat-46 (g) | 0.0 | 0.0 | | 0.0 | 0.0 | 0.0 | 10.9 | 10.9 | 10.9 | 10.9 | 10.9 |
| | | Polyol type | PHA1000 | PHA1000 | | PHA1000 | PHA1000 | PHA1000 | PHA1000 | PHA1000 | PHA1000 | PHA1000 | PHA1000 |
| | | Amount of polyol (g) | 346.1 | 325.7 | | 325.7 | 285.0 | 255.3 | 281.2 | 281.2 | 281.2 | 281.2 | 281.2 |
| | | Amount of Polycat 46 (g) | 0.13 | 0.13 | | 0.13 | 0.13 | 0.13 | 0.13 | 0.13 | 0.13 | 0.13 | 0.13 |
| | | No. 25 (g) | 0.55 | 0.55 | | 0.55 | 0.55 | 0.55 | 0.55 | 0.55 | 0.55 | 0.55 | 0.55 |
| | Post-treatment | | None | None | | None | None | None | None | None | None | None | None |
| | Adhesive | | CHEMLOK 219 | CHEMLOK 219 | | CHEMLOK 219 | CHEMLOK 219 | CHEMLOK 219 | METALOC UA | CHEMLOK 219 | METALOC UA | CHEMLOK 219 | METALOC UA |
| | Release Parting agent | | A | A | A | A | A | A | A | A | A | A | A |
| Elastic modulus | Average value (Mpa) | | 44 | 52 | | 57 | 57 | 60 | 19 | 19 | 19 | 19 | 19 |
| | Standard deviation (Mpa) | | 1.28 | 1.42 | | 1.98 | 1.8 | 2.02 | 0.78 | 0.78 | 0.78 | 0.78 | 0.78 |
| | Variation coefficient (%) | | 2.9 | 2.7 | | 3.5 | 3.2 | 3.4 | 4.1 | 4.1 | 4.1 | 4.1 | 4.1 |
| Martens hardness | Difference between surface and inside: [HM1-HM2] (N/m $m^2$) | | 0.07 | 0.08 | | 0.08 | 0.08 | 0.08 | 0.02 | 0.02 | 0.02 | 0.02 | 0.02 |
| Number of hard segments | P0 | S1 | 1123 | 1284 | | 1284 | 1311 | 1407 | 471 | 471 | 471 | 471 | 471 |
| | | (S2/S1) × 100 | 95 | 96 | | 96 | 96 | 97 | 93 | 93 | 93 | 93 | 93 |
| | P1 | S1 | 1090 | 1245 | | 1245 | 1373 | 1456 | 451 | 451 | 451 | 451 | 451 |
| | | (S2/S1) × 100 | 95 | 96 | | 96 | 96 | 96 | 93 | 93 | 93 | 93 | 93 |
| | P2 | S1 | 1184 | 1304 | | 1304 | 1305 | 1399 | 445 | 445 | 445 | 445 | 445 |
| | | (S2/S1) × 100 | 94 | 97 | | 97 | 96 | 98 | 93 | 93 | 93 | 93 | 93 |
| Mass analysis | | M2/M1 | 0.008 | 0.011 | | 0.014 | 0.012 | 0.012 | 0.002 | 0.002 | 0 002 | 0.002 | 0.002 |
| | | M3/M1 | 0.05 | 0.05 | | 0.04 | 0.05 | 0.05 | 0.09 | 0.09 | 0.09 | 0.09 | 0.09 |
| | | M4/M1 | 0.000 | 0.000 | | 0.000 | 0.000 | 0.000 | 0.001 | 0.001 | 0.001 | 0.001 | 0.001 |
| Concentration of trifunctional alcohol (mmol/g) | | | 0.32 | 0.31 | | 0.31 | 0.28 | 0.36 | 0.23 | 0.23 | 0.23 | 0.23 | 0.23 |
| DSC endothermic peak | Melting start temperature (° C.) | | 188 | 189 | | 190 | 190 | 190 | 183 | 183 | 183 | 183 | 183 |
| | Peak top temperature (° C.) | | 210 | 211 | | 211 | 212 | 212 | 210 | 210 | 210 | 210 | 210 |
| | Difference between melting start temperature and peak top temperature (° C.) | | 23 | 22 | | 21 | 22 | 22 | 27 | 27 | 27 | 27 | 27 |
| Actual apparatus evaluation | Toner | | Toner 1 | Toner 1 | Toner 1 | Toner 1 | Toner 1 | Toner 1 | Toner 1 | Toner 1 | Toner 1 | Toner 1 | Toner 1 |
| | Cleaning property | Normal | Not occurred | Not occurred | Not occurred | Not occurred | Not occurred | Not occurred | Not occurred | Not occurred | Not occurred | Not occurred | Not occurred |
| | | Double | Not occurred | Very slight | Very slight | Very slight | Slight | Slight | Slight | Slight | Slight | Slight | Slight |
| | | Rank A~E | A | B | B | B | C | C | C | C | C | C | C |
| | Edge chipping | Rank A~D | $A^+$ | $A^+$ | B | $A^+$ | $A^+$ | C | C | C | C | C | C |
| | Total evaluation | | A | A | B | A | B | C | C | C | C | C | C |

TABLE 4

| | | | Example 31 | Example 32 | Example 33 | Comparative Example 1 | Comparative Example 2 | Comparative Example 3 | Comparative Example 4 |
|---|---|---|---|---|---|---|---|---|---|
| Compounding | Propolymer | Amount of MDI (g) | 345.5 | 269.2 | 187.5 | 334.7 | 334.7 | 296.6 | 296.6 |
| | | Polymeric MDI type | MR400 | MR400 | MR400 | — | — | — | — |
| | | Amount of polymeric MDI (g) | 20.0 | 120.0 | 220.0 | 0.0 | 0.0 | 0.0 | 0.0 |
| | | Polyol type | PBA2500 | PBA2500 | PBA2500 | PBA2500 | PBA2500 | PBA2500 | PBA2500 |
| | | Amount of polyol (g) | 634.5 | 610.8 | 592.5 | 665.3 | 665.3 | 703.4 | 703.4 |
| | Curing agent | Triol type | Glycerin | Glycerin | TMP | Glycerin | Glycerin | Glycerin | Glycerin |
| | | Amount of triol (g) | 42.2 | 27.7 | 63.8 | 15.5 | 15.5 | 15.5 | 39.7 |
| | | Amount of 1,4-BDPolycat-46 (g) | 7.0 | 13.8 | 0.0 | 19.4 | 19.4 | 62.0 | 26.5 |
| | | Polyol type | PHA1000 | PHA1000 | PHA1000 | PBA1000 | PBA1000 | — | — |
| | | Amount of polyol (g) | 302.7 | 304.4 | 255.3 | 159.0 | 159.0 | 0 | 0 |
| | | Amount of Polycat 46 (g) | 0.13 | 0.13 | 0.13 | 0.13 | 0.13 | 0 | 0 |
| | | No.25 (g) | 0.55 | 0.55 | 0.55 | 0.55 | 0.55 | 0.23 | 0.23 |
| | Post-treatment | | UV treatment, integrated luminous energy 492 | UV treatment, integrated luminous energy 1968 | UV treatment, integrated luminous energy 3936 | None | UV treatment, integrated luminous energy 4920 | Immersion in 4,4'-MDI, 80° C. 3 min | None |
| | Adhesive | | CHEMLOK 219 | CHEMLOK 219 | CHEMLOK 219 | CHEMLOK 219 | CHEMLOK 219 | CHEMLOK 219 | CHEMLOK 219 |
| | Release Parting agent | | A | A | A | A | A | A | A |
| Elastic modulus | Average value (Mpa) | | 66 | 233 | 463 | 14 | 518 | 452 | 28 |
| | Standard deviation (Mpa) | | 3.20 | 9.40 | 22.20 | 0.86 | 10.30 | 29.20 | 1.76 |
| | Variation coefficient (%) | | 4.8 | 4.0 | 4.8 | 6.1 | 2.0 | 6.5 | 6.3 |
| Martens hardness | Difference between surface and inside: [HM1-HM2] ($N/mm^2$) | | 0.02 | 0.03 | 0.08 | 0.01 | 0.01 | 2.72 | 0.03 |
| Number of hard segments | P0 | S1 | 348 | 756 | 1407 | 286 | 286 | 315 | 285 |
| | | (S2/S1) × 100 | 94 | 93 | 97 | 91 | 91 | 90 | 91 |
| | P1 | S1 | 343 | 726 | 1456 | 295 | 295 | 320 | 288 |
| | | (S2/S1) × 100 | 92 | 94 | 96 | 92 | 92 | 90 | 92 |
| | P2 | S1 | 335 | 745 | 1399 | 290 | 290 | 305 | 278 |
| | | (S2/S1) × 100 | 93 | 94 | 98 | 92 | 92 | 91 | 91 |
| Mass analysis | M2/M1 | | 0.001 | 0.004 | 0.012 | 0.000 | 0.000 | 0.000 | 0.000 |
| | M3/M1 | | 0.09 | 0.07 | 0.05 | 0.10 | 0.10 | 0.43 | 0.10 |
| | M4/M1 | | 0.000 | 0.000 | 0.000 | 0.001 | 0.001 | 0.000 | 0.000 |
| Concentration of trifunctional alcohol (mmol/g) | | | 0.34 | 0.22 | 0.36 | 0.14 | 0.14 | 0.16 | 0.40 |
| DSC endothermic peak | Melting start temperature (° C.) | | 182 | 186 | 190 | 170 | 170 | 105 | 105 |
| | Peak top temperature (° C.) | | 210 | 211 | 212 | 176 | 176 | 115 | 122 |
| | Difference between melting start temperature and peak top temperature (° C.) | | 28 | 25 | 22 | 6 | 6 | 10 | 17 |
| Actual apparatus evaluation | Toner | | Toner 1 | Toner 1 | | Toner 1 | Toner 1 | Toner 1 | Toner 1 |
| | Cleaning property | Normal | Not occurred | Not occurred | Not occurred | Occurred | Not occurred | Occurred | Not occurred |
| | | Double | Slight | Slight | Slight | Occurred | Occurred | Occurred | Occurred |
| | | Rank A~E | C | C | C | E | D | E | D |
| | Edge chipping | Rank A~D | $A^+$ | $A^+$ | $A^+$ | D | B | D | D |
| | | Total evaluation | B | B | B | E | D | E | D |

According to one aspect of the present disclosure, it is possible to obtain a cleaning blade that has excellent chipping resistance and can stably exhibit excellent cleaning performance. Further, according to another aspect of the present disclosure, it is possible to obtain a process cartridge that contributes to the formation of high-quality electrophotographic images. Furthermore, according to yet another aspect of the present disclosure, it is possible to obtain an electrophotographic image forming apparatus capable of stably forming high-quality electrophotographic images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 10 μm from the tip-side edge is drawn on the tip surface in parallel with the tip-side edge, where a length of the line segment is denoted by L and points at ⅛L, ½L, and ⅞L from one end side on the line segment are denoted by P0, P1, and P2, respectively, an average value of an elastic modulus of the elastic member measured using SPM at each of 70 points with a pitch of 1 μm on the line segment centered on each of the P0, the P1 and the P2 on the line segment is 15 MPa to 470 MPa;

a coefficient of variation of the elastic modulus is not more than 6.0%; and an absolute value of a difference between a Martens hardness HM1 of the elastic member measured at a position of the P1 and a Martens hardness HM2 measured at a position on a bisector at a distance of 500 μm from the tip-side edge, when assumed that the bisector of an angle formed by the main surface and the tip surface is drawn on a cross section of the elastic member including the P1 and orthogonal to the tip surface and the tip-side edge, is not more than 0.10 $N/mm^2$.

2. A process cartridge having the electrophotographic cleaning blade according to claim 1.

3. An electrophotographic image forming apparatus having the electrophotographic cleaning blade according to claim 1.

4. An electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 10 μm from the tip-side edge is drawn on the tip surface in parallel with the tip-side edge, where a length of the line segment is denoted by L and points at ⅛L, ½L, and ⅞L from one end side on the line segment are denoted by P0, P1, and P2, respectively, in each of three square observation regions on the tip surface having each of the P0, the P1, and the P2 as a center of gravity and a side length of 1 μm and one side parallel to the line segment, a proportion [(S2/S1)×100)] of a number (S2) of hard segments having a circle-equivalent diameter of not more than 40 nm in a total number (S1) of hard segments is at least 92%, and the S1 is 300 to 1500.

5. An electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 0.5 mm from the tip-side edge is drawn on the tip surface in parallel with the tip-side edge, where a length of the line segment is denoted by L' and points at ⅛L', ½L', and ⅞L' from one end side on the line segment are denoted by P0', P1', and P2', respectively, and when a sample sampled at each of the P0', the P1', and the P2' is heated to 1000° C. at a temperature rise rate of 10° C./s by using a mass analyzer of a direct sample introduction type in which the sample is heated and vaporized in an ionization chamber and molecules of the sample are ionized, M2/M1 is 0.001 to 0.015, M3/M1 is 0.04 to 0.10, and M4/M1 is not more than 0.001 where M1 is a detection amount of all ions,

M2 is an integrated intensity of a peak of an extracted ion thermogram corresponding to an m/z value in a range of 380.5 to 381.5 derived from a polymeric MDI, M3 is an integrated intensity of a peak of an extracted ion thermogram corresponding to an m/z value in a range of 249.5 to 250.5 derived from 4,4'-MDI, and M4 is an integrated intensity of a peak of an extracted ion thermogram corresponding to an m/z value in a range of 749.5 to 750.5 derived from an isocyanurate form of 4,4'-MDI, and wherein a concentration of a trifunctional alcohol in the polyurethane is 0.22 to 0.39 mmol/g.

6. The electrophotographic cleaning blade according to claim 5, wherein the trifunctional alcohol is trimethylolpropane.

7. An electrophotographic cleaning blade comprising an elastic member that comprises a polyurethane and a support member that supports the elastic member, and cleaning a surface of a member to be cleaned that is moving, by bringing a part of the elastic member into contact with the surface of the member to be cleaned, wherein when a side of the cleaning blade that comes into contact with the surface of the member to be cleaned is defined as a tip side of the cleaning blade, the elastic member has, at least on the tip side, a plate shape having a main surface facing the member to be cleaned and a tip surface forming, together with the main surface, a tip-side edge;

assuming that a line segment having a distance of 0.5 mm from the tip-side edge is drawn on the tip surface in parallel with the tip-side edge, where a length of the line segment is denoted by L' and points at ⅛L', ½L', and ⅞L' from one end side on the line segment are denoted by P0', P1', and P2', respectively, in a DSC chart obtained by differential scanning calorimetry of samples sampled in each of the P0', the P1', and the P2', a peak top temperature of the only endothermic peak is at least 200° C., a melting start temperature of the endothermic peak is at least 175° C., and a difference between the melting start temperature and the peak top temperature is at least 15° C.

* * * * *